US011571061B2

(12) United States Patent
Varch et al.

(10) Patent No.: US 11,571,061 B2
(45) Date of Patent: Feb. 7, 2023

(54) BRUSH HEAD MANUFACTURING METHOD, AND BRUSH HEAD

(71) Applicant: KONINKLIJKE PHILIPS N.V., Eindhoven (NL)

(72) Inventors: Martin Varch, St. Margareten (AT); Michael Meidl, Seeboden (AT); Florian Kopeinig, Klagenfurt (AT); Thomas Johannes Gaertner, Villach (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 170 days.

(21) Appl. No.: 16/761,570

(22) PCT Filed: Jun. 20, 2018

(86) PCT No.: PCT/EP2018/066335
§ 371 (c)(1),
(2) Date: May 5, 2020

(87) PCT Pub. No.: WO2019/091603
PCT Pub. Date: May 16, 2019

(65) Prior Publication Data

US 2020/0260857 A1 Aug. 20, 2020

Related U.S. Application Data

(60) Provisional application No. 62/582,339, filed on Nov. 7, 2017.

(51) Int. Cl.

| | |
|---|---|
| ***A46D 3/00*** | (2006.01) |
| ***A46D 3/04*** | (2006.01) |
| ***A46B 9/04*** | (2006.01) |

(52) U.S. Cl.
CPC ..... *A46D 3/005* (2013.01); *A46B 9/04* (2013.01); *A46D 3/045* (2013.01)

(58) Field of Classification Search
CPC ..... A46B 3/00; A46D 3/005; A46D 3/045
(Continued)

(56) References Cited

U.S. PATENT DOCUMENTS 5,970,564 A 10/1999 Inns
6,045,649 A * 4/2000 Weihrauch ..... B29C 65/1677 156/272.8
(Continued)

FOREIGN PATENT DOCUMENTS

DE 10221786 A1 11/2003
DE 20301634 U1 6/2004
(Continued)

OTHER PUBLICATIONS

Computer generated English translation of WO2004/080238 A1, Clos, Sep. 2004. (Year: 2004).*
(Continued)

*Primary Examiner* — Laura C Guidotti

(57) ABSTRACT

A brush head (10) and a method for manufacturing a brush head. The method includes forming a plurality of retention elements (52) each having an opening (51) therethrough. The retention elements (52) are positioned into corresponding recesses of a plate. A bristle tuft (21) is inserted into each of the openings of the retention elements. A proximal end (23) of each bristle tuft is bonded to the corresponding proximal side of the retention element to form a merged proximal end head portion (26) that secures the bristle tufts and the corresponding retention elements together as a plurality of merged tuft assemblies (20). A neck (40) of the brush head is positioned in relation to the merged tuft
(Continued)

assemblies. A platen (42) of the neck and the merged tuft assemblies is at least partially encompassed in a matrix (30).

4 Claims, 17 Drawing Sheets

(58) Field of Classification Search
USPC ..... 300/21
See application file for complete search history.

(56) References Cited

U.S. PATENT DOCUMENTS

| | | | |
|---|---|---|---|
| 6,220,673 | B1 | 4/2001 | Russell |
| 3,069,524 | A1 | 12/2011 | Kraemer |
| 2010/0043165 | A1 | 2/2010 | Juentgen et al. |
| 2013/0291320 | A1 | 11/2013 | Kirchhofer et al. |
| 2015/0026905 | A1 | 1/2015 | Jensen |
| 2017/0086572 | A1 | 3/2017 | Dengler |
| 2020/0315334 | A1 | 10/2020 | Meidl |

FOREIGN PATENT DOCUMENTS

| | | | | |
|---|---|---|---|---|
| EP | 1603429 | B1 | 8/2007 | |
| WO | WO2004/080238 | A1 * | 9/2004 | ..... A46D 3/04 |

OTHER PUBLICATIONS

International Search Report and Written Opinion, International Application No. PCT/EP2018/066335, dated Oct. 23, 2018.

* cited by examiner

BRUSH HEAD MANUFACTURING METHOD, AND BRUSH HEAD

This application is the U.S. National Phase application under 35 U.S.C. § 371 of International Application No. PCT/EP2018/066335, filed on 20 Jun. 2018, which claims the benefit of U.S. Provisional Application No. 62/582,339, filed 7 Nov. 2017. These applications are hereby incorporated by reference herein.

FIELD OF THE INVENTION

The present disclosure is directed generally to methods for manufacturing a brush head assembly with anchor-free bristle tufts overmolded with an elastomeric matrix.

BACKGROUND

The brush heads of both manual and power toothbrushes comprise bristles which are used to clean the teeth, tongue, and cheeks. In some toothbrushes, the bristles are stapled, or anchored, into the neck portion of the brush head. In other toothbrushes, the bristles are held in the head without staples, in methods commonly known as "anchor free tufting".

There are several ways to manufacture brush heads having anchor-free tufting. In one method, groups, or tufts, of individual bristles are melted or fused together at one end, and then the bristle tufts are overmolded with a material that then hardens, forming a brush head. In another method, bristle tufts that are fused at one end are inserted into holes in the brush neck, and either the neck material is heated to shrink around the bristle tufts, or the brush neck with the inserted bristle tufts are overmolded. However, there are limitations and difficulties with each of these current manufacturing methods such that the manufacturing methods are slow, involve multiple steps and equipment, or have higher than acceptable failure rates, resulting in loose bristles or bristle tufts which can come out of the brush head during use.

Accordingly, there is a need in the art for methods and apparatus for more efficiently manufacturing brush heads with anchor free tufting.

SUMMARY OF THE INVENTION

The present disclosure is directed to inventive methods for manufacturing a brush head with secured bristle tufts. Various embodiments and implementations herein are directed to manufacturing methods in which a tuft carrier with one or more retention elements and openings formed therethrough is used to retain tufts of bristles. Bristle tuft are then inserted into the openings in the retention elements. Once the bristle tufts have been inserted into the openings in the retention element, optionally, either or both ends of the bristle tufts can be trimmed or adjusted to achieve a desired length and/or contour to what will become the brushing surface of the brush head, and/or to achieve a uniform length of the bristle tufts on the proximal side of the retention element.

The proximal end of the bristle tufts, or in some arrangements the proximal end of the bristle tufts and proximal side of the retention elements are then bonded together using for example, a laser, heat, chemical interaction or adhesive to form a proximal end head portion or a merged proximal end head portion. Optionally, after cooling from the melting process, at this point, if not done previously, the retention element with melted or merged bristle tufts can be separated into individual merged tuft assemblies.

Subsequently, a brush neck is positioned in or over a base plate that contains the merged tuft retention element(s). An elastomeric material is injected around a portion of the brush neck and merged tuft retention element(s), which, when cooled, forms an elastomeric matrix that bonds the neck, retention element and melted proximal end of the bristle tufts together to form a brush head. The various embodiments and implementations herein provide a cost-effective and efficient production of brush heads with anchor free bristle tufts is substantially improved.

Generally, in one aspect, a method for manufacturing a brush head is provided. The method includes forming a plurality of retention elements each having one or more openings therethrough; positioning the retention elements into corresponding recesses of a base plate; inserting a bristle tuft into the opening of each corresponding retention element; bonding a proximal end of each bristle tuft to the corresponding retention element to form a merged proximal end head portion that secures the bristle tufts and the retention elements together as a plurality of merged tuft assemblies; positioning a neck of the brush head in relation to the merged tuft assemblies; and encompassing a platen of the neck and the merged tuft assemblies at least partially in a matrix.

In one embodiment, the bonding includes applying heat to a proximal side of the retention elements and the proximal end of the bristle tufts at a temperature sufficient to at least partially melt and join the bristle tufts to form the merged proximal end head portion. In one embodiment, the bristle tufts and retention elements are made of a same or similar material having the same or a similar melting point. In one embodiment, the bonding includes laser welding.

In one embodiment, the forming includes stamping the retention elements from a strip of backing material. In one embodiment, the retention elements are formed as an interconnected web or a carrier plate.

In one embodiment, the forming includes removing excess material from the retention elements. In one embodiment, the the plurality of retention elements are included by a tuft carrier that comprises a carrier plate, one or more webbing links, or a combination including at least one of the foregoing. In one embodiment, the method further includes stamping the tuft carrier to remove some or all of the carrier plate or the webbing links or to remove excess material to form the carrier plate or the webbing links.

In one embodiment, the retention elements are not removed from the recesses of the base plate during at least two of the inserting, bonding, positioning, and injecting steps performed sequentially. In one embodiment, the openings in the retention elements are of differing shapes and sizes. In one embodiment, the encompassing includes overmolding the merged tuft assemblies and the platen with the matrix.

In one embodiment, the encompassing includes injecting the merged tuft assemblies in the form of tuft spikes into the matrix after solidification of the matrix. In one embodiment, the method further includes adjusting characteristics of the proximal end or a free end, opposite to the proximal end, of the bristle tufts.

Generally, in another aspect, a brush head is provided. The brush head includes a plurality of merged tuft assemblies, each comprising: a bristle tuft comprising a plurality of bristle strands and having a free end and a proximal end; a retention element having an opening therethough configured to receive the bristle tuft; and a merged proximal end head portion formed by bonding the proximal end of the bristle tuft to the retention element; a neck having a platen; and a matrix at least partially encompassing the platen and the retention elements of the merged tuft assemblies.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a method for manufacturing a brush head assembly with bristle tufts retained by anchor free tufting in a retention element secured in a molded elastomeric matrix. More generally, applicants have recognized the need for improvements in manufacturing methods and products made using anchor free tufting. By molding carriers, and in some arrangements, molding carriers from the same or similar material as the bristle tufts, efficiencies in manufacturing are achieved with improved product quality.

Figure 1A:
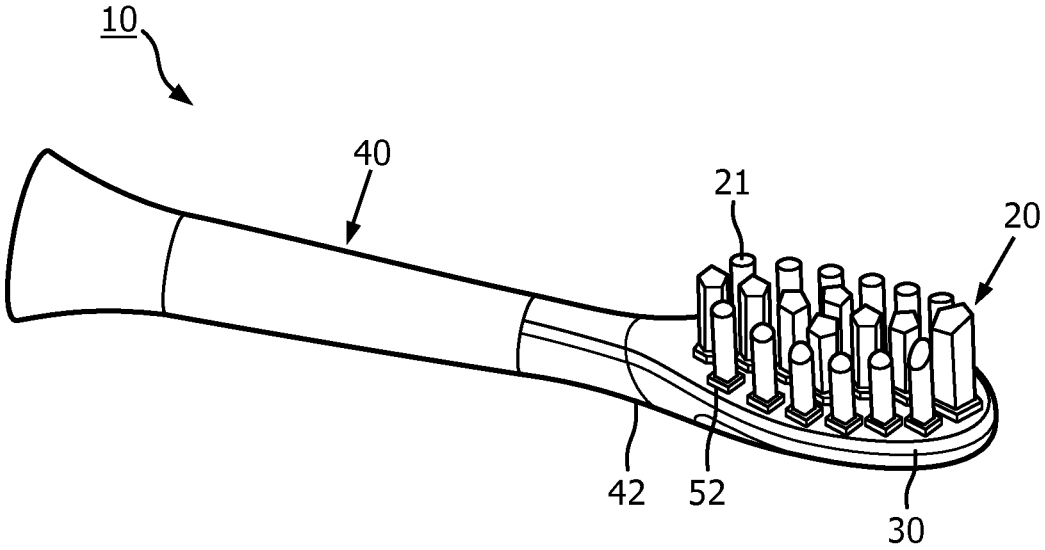
FIG. 1A is a perspective schematic representation of a brush head assembly in accordance with an embodiment.
Figure 1B:
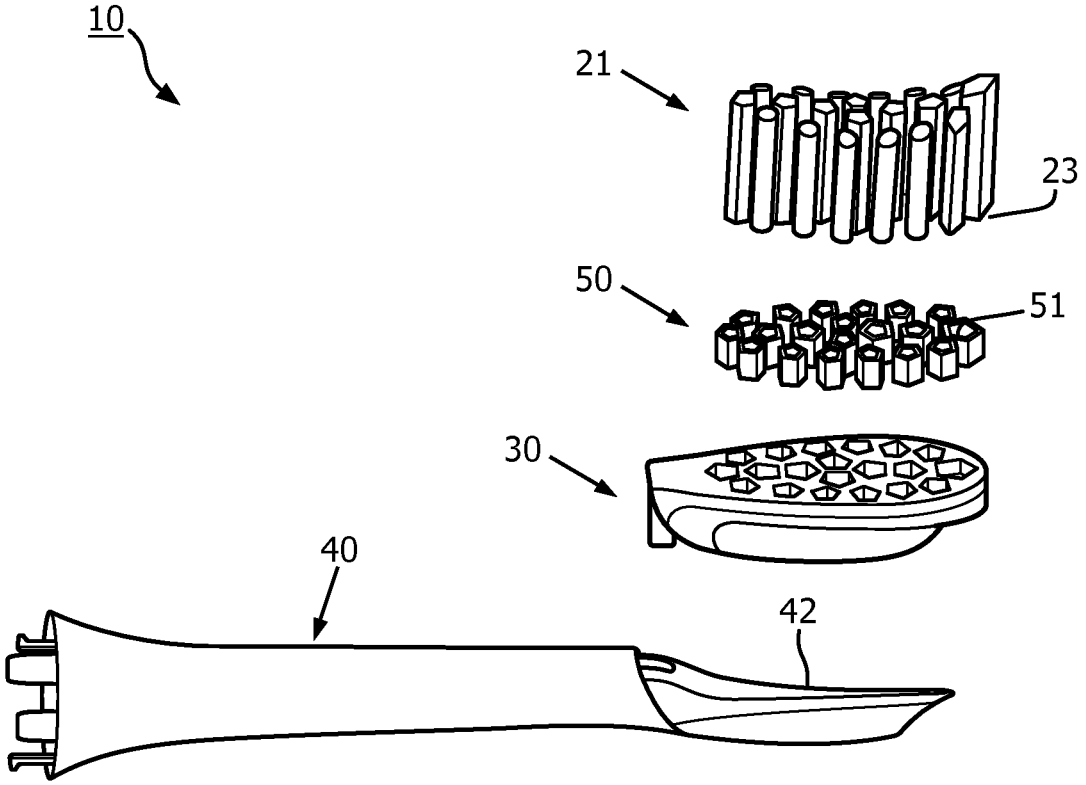
FIG. 1B is a perspective exploded view of the brush head assembly of FIG. 1A.

Referring to FIGS. 1A-1B, in one embodiment, a schematic representation of a brush head assembly 10 is provided. More particularly, the brush head assembly 10 may include, but is not limited to, a plurality of bristle tufts 21 disposed within a matrix 30 at a distal end of a neck 40. That is, a distal portion 42 of the neck 40, which may be referred to as a platen, may be at least partially enclosed in and connected to the matrix 30. The platen 42 may be, or include, a generally flat portion that provides a hard, rigid, or otherwise reinforcing substrate that is aligned with the bristles of the merged tuft assemblies 20 to support the bristles of the brush head assembly 10 during use. The merged tuft assemblies 20 may include a tuft carrier 50 having one or more retention elements 52, in which bristle tufts 21 are secured as discussed in more detail herein. The neck 40 can be coupled to, or form a part of, any manual or powered toothbrush shaft. For example, the neck 40 may be configured to be removably coupled to an actuator or drive shaft (not shown) of a powered oral care device (e.g., electric toothbrush) now known or to be developed.

Figure 2A:
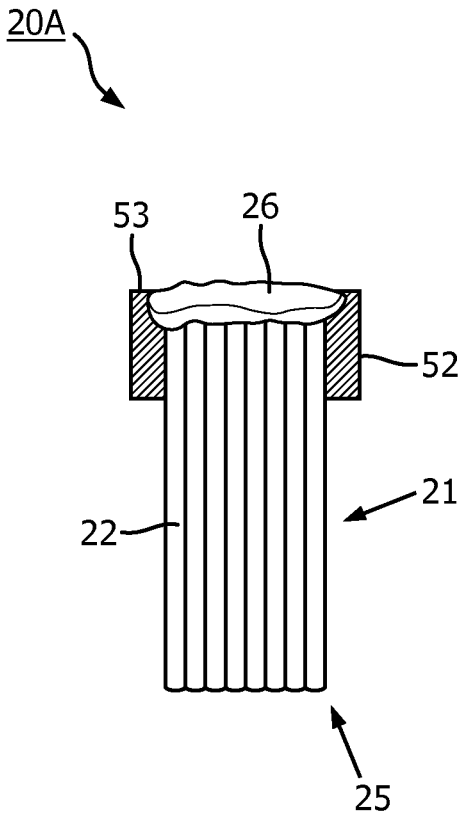
FIGS. 2A and 2B are cross-sectional side views of schematic representations of merged tuft assemblies according to two embodiments disclosed herein.
Figure 2B:
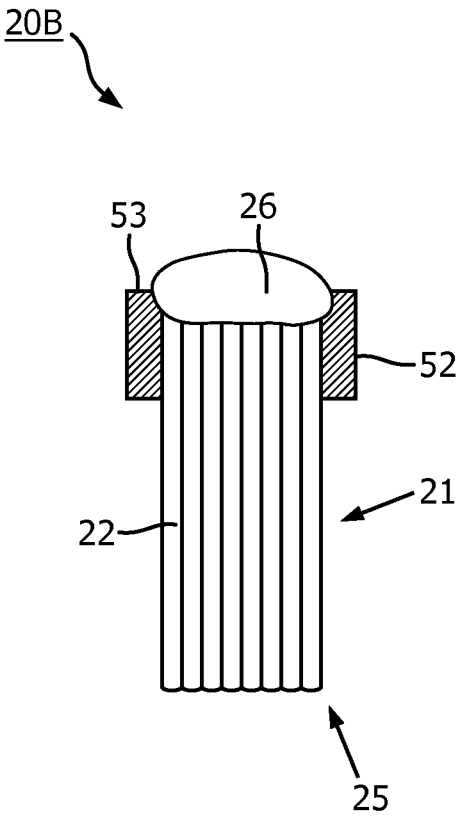

Two examples for the merged tuft assemblies 20 are illustrated in FIGS. 2A and 2B, designated as merged tuft assemblies 20A and 20B, respectively. It is to be appreciated that the reference numeral '20' is intended to generally refer to any of the merged tuft assemblies disclosed herein, while the assemblies 20A and 20B are used herein to facilitate discussion with respect to particular embodiments. It is also to be appreciated that many components of the merged tuft assemblies 20 are shared throughout embodiments, and thus referred to with the same reference numerals.

Figure 2C:
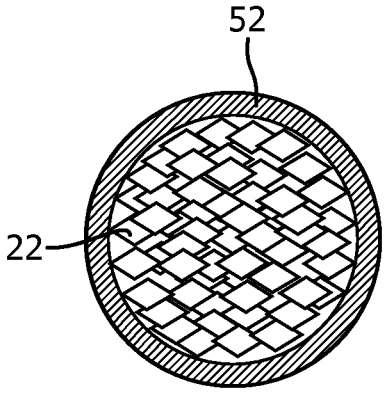
FIG. 2C is a bottom view of a bristle tuft engaged in a retention element of a tuft carrier.

Referring to FIGS. 1-2C, each bristle tuft 21 comprises a plurality of bristle strands 22, which are secured in the retention elements 52 of tuft carrier 50. Each bristle tuft 21 has a proximal end 23 and a free end 25. The proximal end 23 of each bristle tuft 21 is retained within an opening 51 of each of the retention elements 52 of the tuft carrier 50, while the free end 25 is located opposite to the proximal end 23 and forms the brushing surface force the brush head 10 when assembled. The bristle tufts 21 can be formed to a shape and diameter to match the size and shape of the openings 51 in the retention element 52.

It is to be appreciated that the various components of the brush head 10 may take any desire size, shape, and/or orientation. For example, as seen in FIG. 1A, the retention elements and bristle tufts contained therein can be round, pentagonal, hexagonal, or a variety of other shapes, such as squares, diamonds, heptagons, octagons, etc Additionally, the retention elements 52 and the openings 51 therein can be of the same size, shape and arrangement as each other, or different shapes and sizes. For example, the retention element 52 may have a first shape defining its periphery, while the opening 51 has a second, different shape defining the shape of the bristle tuft 21 inserted therethrough.

Once the bristle tufts 21 are inserted in the opening 51 of the retention element 52, the proximal end 23 of the bristle tufts 21, or in some arrangements, the proximal end 23 of the bristle tufts 21 and at least a portion of a proximal side 53 of the retention element 52 are bonded together to form a merged proximal end head portion 26. That is, the merged proximal head portion 26 may be formed from fused material from the bristles 22 alone, or the bristles 22 together with a portion of the retention element 52 adjacent to the bristles 22. In one embodiment, the bristle tufts and/or the retention elements 52 are bonded together by any suitable process such as welding (ultrasonic, laser, etc.), melting, adhesives, etc.

In order to facilitate formation of the merged proximal head portion 26 such as shown in FIGS. 2A-2B, the tuft carriers 50 and the bristle tufts 21 are preferably made from the same material, or materials having a similar composition. Plastics such as Acrylonitrile Butadiene Styrene (ABS), polyamide (PA) or nylon, polypropylene, or variations or combinations of these or other materials can be used. Particularly useful are combinations of materials that have a similar co-efficient of melting to facilitate bonding by melting and cooling at a similar temperature and rate. In one embodiment, the bristles 22 are formed from PA, while the retention elements 52 are formed from a PA/ABS blend. It is to be appreciated that there may be some variability across the weld of the merged proximal end head portion 26, e.g., based on the characteristics of the materials of the bristle strands 22 and/or the retention elements 52, as well as the parameters utilized during welding. In particular, variation may occur if the bristle tuft 21 and the retention elements 52 are made of different materials, which may cause melting/cooling at different temperatures, or other differences due to their different chemical compositions. However, such variability is acceptable as long as the desired bonding is achieved.

Figure 2D:
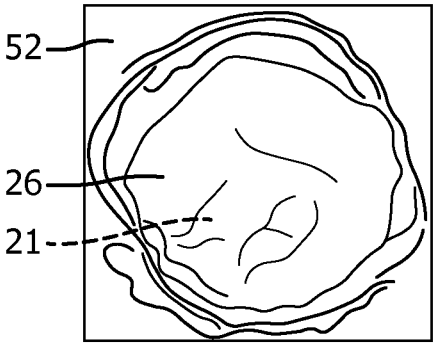
FIG. 2D is a top view of a merged proximal end head portion of a merged tuft assembly after laser welding.

Advantageously, in one embodiment, a laser welding process is used, which can effectively melt and bond the bristle tufts 21 and retention elements 52 together to form the merged proximal head portion 26 as a seal that completely seals across the opening 51 at the proximal end 23 of the merged tuft assemblies 20. For laser welding, the laser concentrates the welding energy more precisely, while enabling more exact application of heat, so that the proximal ends 23 of the bristle tufts 21 and the proximal side 53 of retention elements 52 melt to from a substantially uniform merged proximal end head portion 26, e.g., as shown in FIG. 2D.

The tuft carriers 50 and/or retention elements 52 can be formed in a variety of ways, such as molding, stamping, etc., as discussed in more detail herein. Various embodiments for the tuft carriers 50 can be appreciated in FIGS. 3A-3F. The reference numeral '50' as used herein is intended to refer generally to all embodiments of tuft carriers disclosed or envisioned, while alphabetic suffixes (e.g., 'A', 'B', etc.) have been provided to facilitate discussions of particular embodiments shown in the Figures. A similar naming style may be utilized with respect other components herein.

Figure 3A:
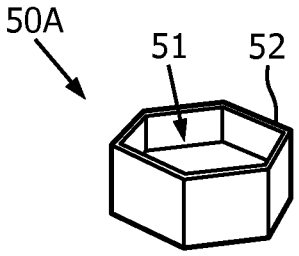
FIGS. 3A-3F are schematic representations of tuft carriers according to different embodiments disclosed herein.
Figure 3B:
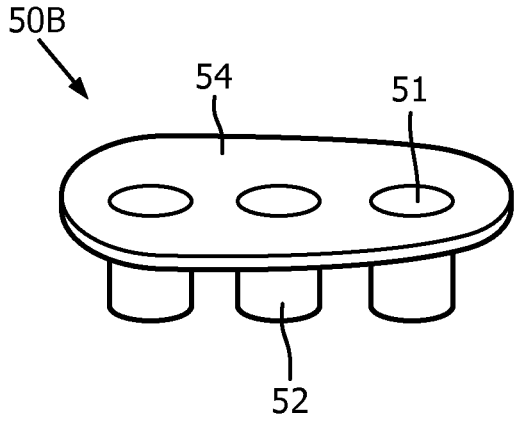
Figure 3C:
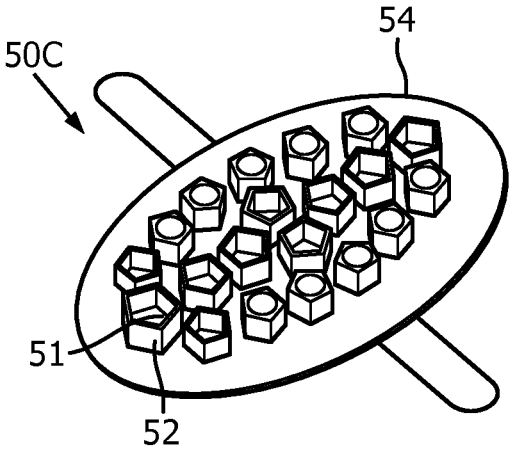
Figure 3D:
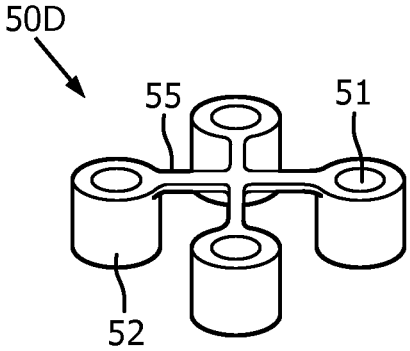
Figure 3E:
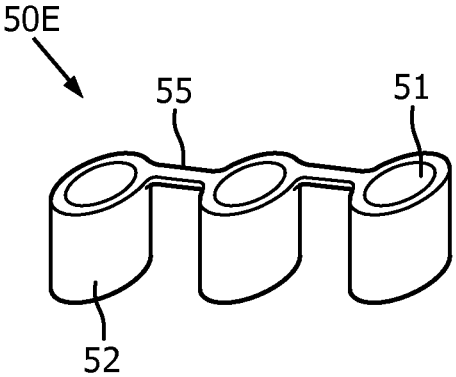
Figure 3F:
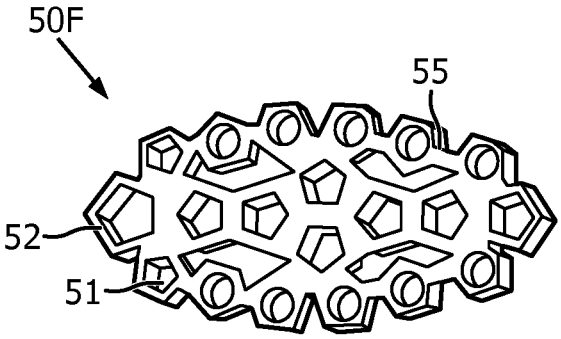

A tuft carrier 50A in FIG. 3A comprises a single one of the retention elements 52, which will hold a at least one of the bristle tufts 21 in the opening 51 of the retention element 50A. FIGS. 3B and 3C respectively show a tuft carrier 50B and a tuft carrier 50C that each comprises a carrier plate 54 having a plurality of the retention elements 52 connected together, e.g., arranged in a shape of the final brush head or some portion thereof. In FIGS. 3D-3F, tuft carriers 50D, 50E, and 50F are respectively shown. Each of the tuft carriers 50D-50F comprise a tuft carrier web that has a plurality of individual retention elements 52 connected to each other by a series of strands or webbing links 55. In this way, it is to be appreciated that the retention elements 52 can be separate discrete units, or interconnected together, such as by the carrier plate 54 or the webbing links 55. Similar to the tuft carriers 50B and 50C, the retention elements 52 and/or the openings 51 of the tuft carriers 50D-50F may be arranged in the desired pattern for the tufts 21 when the brush head is fully assembled, or some portion thereof.

In one embodiment, the tuft carriers 50 are formed via a molding operation, such as injection molding. The actual shape and size of the tuft carrier 50, the number, size, and shape of the openings 51, etc., can be set and determined by the mold used to form the carrier 50. Once the carrier 50 has been formed and cooled, it can optionally be removed from the mold, and is ready for further processing, either immediately, or at a later time and/or place.

Figure 4:
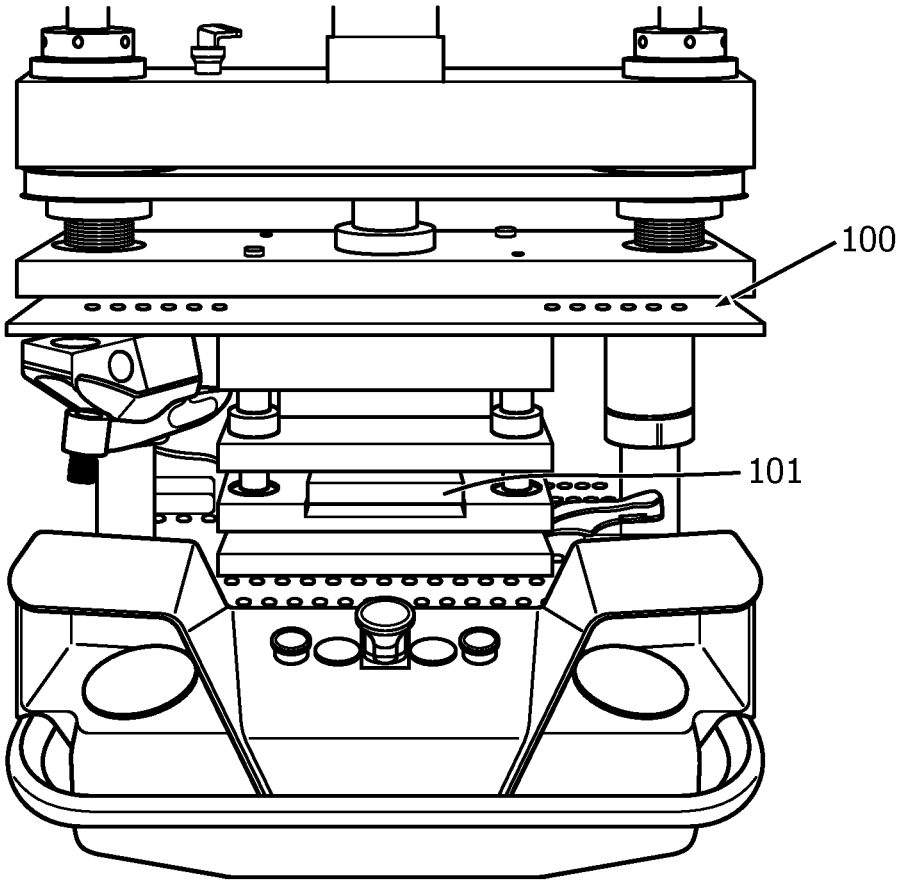
FIG. 4 is a representation of a stamping tool for manufacturing a brush head assembly of the present invention.
Figure 5A:
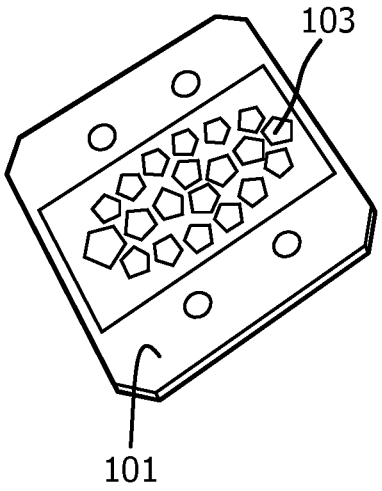
FIGS. 5A-5C show successive steps of using a die block (or handling plate) to stamp out retention elements of a tuft carrier according to one embodiment disclosed herein.
Figure 5B:
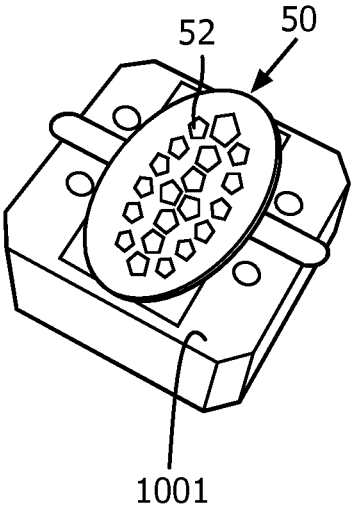

According to embodiments disclosed and envisioned herein, at least a portion of the tuft carrier 50 may be removed prior to assembly of the retention elements 52 in the brush head 10. In one embodiment, the removal of excess material is performed by a stamping tool 100 shown in FIG. 4. For example, the stamping tool 100 may include a press, ram, stamp, or die that forcibly engages the tuft carrier 50 placed in a die block or handling plate 101, as shown in FIG. 5B to cut apart, disconnect, or otherwise separate one or more portions of the tuft carrier 50 from each other.

Figure 5C:
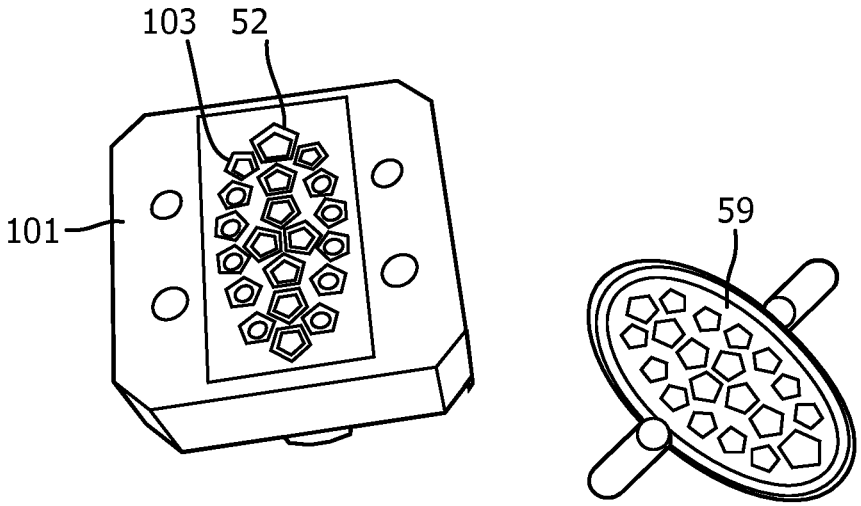

The die block 101 or handling plate has a series of openings 103 configured to match the retention elements 52 in the tuft carrier 50 in size, shape and arrangement. Namely, the openings 103 of the die block or handling plate 101 of FIGS. 5A-5C corresponds to the size, shape, and layout of the tuft carrier 50C from FIG. 3C. In this way, as shown in FIG. 5B, the retention elements 52 of the tuft carrier 50C can be inserted into the openings 103 of the die block handling plate 101. The die block or handling plate 101, together with the tuft carrier 50C, can be loaded into, and stamped by, the stamping tool 100. As shown in FIG. 5C, the stamping operation may disconnect or separate the retention elements 52 from excess material 59. The excess material 59 may be recycled or discarded, while the retention elements 52 may remain in the openings 103 of the handling plate 101, or be removed, for further processing. The handling plate 101 may be utilized to facilitate the general handling of the tuft carrier 50 and/or the loading of the tuft carrier 50 into other tools, such as a tufting unit, or other equipment used to create a finished brush head 10. In one arrangement of the present invention, the handling plate 101 with the tuft carrier therein can be positioned on top of a base plate 110 with openings of similar size and shape in similar positions and the tuft carrier may be transferred from the handling plate into the base plate 110. It is also noted that some or all of the excess material 59 of tuft carrier 50 may be removed via other processes, e.g., cutting, or via multiple successive processes, at this step or other steps of the manufacturing process.

Figure 6A:
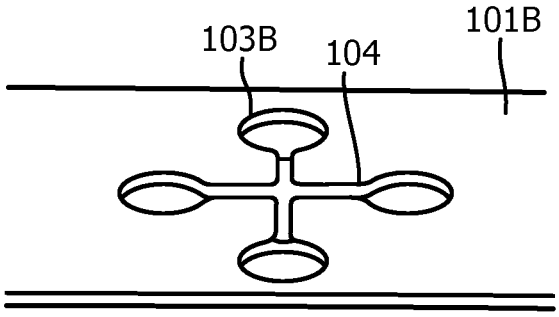
FIGS. 6A-6B show a handling plate and the handle plate engaged with a tuft carrier according to one embodiment disclosed herein.
Figure 6B:
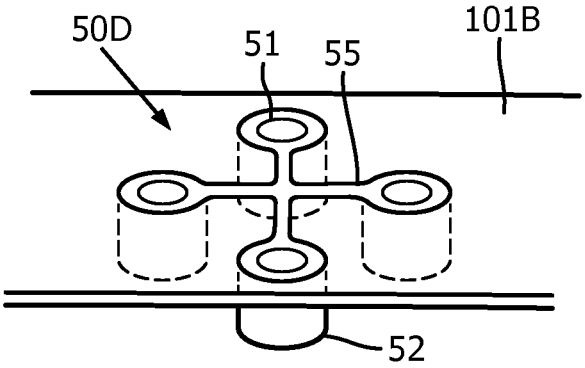

To facilitate handling of a variety of tuft carriers 50 one or more die blocks or handling plates 101 may be used. A die block or handling plate 101B, is illustrated in FIGS. 6A-6B. Namely, the handling plate 101B includes openings 103B, which correspond in shape, size, and layout to the retention elements 52 of the tuft carrier 50D of FIG. 3D, as shown in FIG. 6B. The openings 103B in the die block 101B facilitate stamping of the tuft carrier 50D directly into the die block 101.

Additionally, the handling plate 101B may include a set of grooves or recesses 104, which are shaped and sized to receive the webbing links 55 of the tuft carrier 50D. In this way, for example, the grooves 104 may assist in positioning and holding the tuft carrier 50D during manufacturing. It is noted that the handling plates 101 disclosed and envisioned herein may be removably separated from the base plate 110 or other components of the stamping tool 100, e.g., to facilitate further processing of the corresponding tuft carrier conveyed by the handling plate 101. In this way, the handling plate 101B, together with the tuft carrier 50 stamped into the handling plate, left behind in the grooves 104, may be separated from the excess material, if desired, for further processing.

Figure 7A:
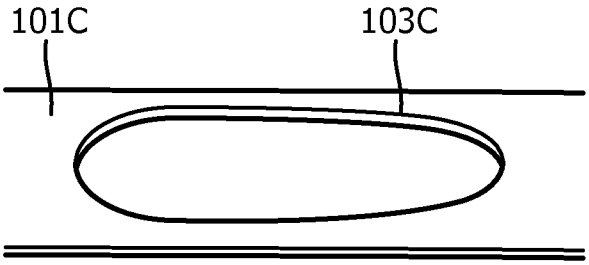
FIGS. 7A-7B show a handling plate and the handle plate engaged with a tuft carrier according to one embodiment disclosed herein.
Figure 7B:
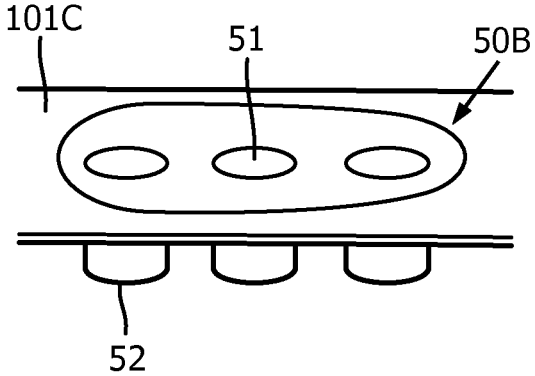

A handling plate 101C according to another embodiment is illustrated in FIGS. 7A-7B. Unlike handling plate 101B, the handling plate 101C includes an opening 103C, which corresponds in general shape, size, and/or layout to the carrier plate 54 of the tuft carrier 50B of FIG. 3B (as opposed to the individual retention elements 52). In this way, some or all the carrier plate 54 may remain with the retention elements 52 for various manufacturing steps, and/or may be included in the brush head 10 during final assembly. For example, in one embodiment, the stamping tool 100 may be configured, with a punch or stamping element to remove only a portion of the carrier plate 54 so as to change the shape of tuft carrier 50B to the shape of the tuft carrier 50F of FIG. 3F. In other words, excess portions of the carrier plate 54 may be removed to leave behind only the webbing links 55. In other embodiments, the carrier plate 54 may be utilized without removing any excess portions.

In one embodiment, the tuft carrier 50 is formed by overmolding the tuft carrier 50 directly onto the corresponding handling plate 101. In this way, the handling plate 101, together with the unprocessed instance of the tuft carrier 50, can be directly placed on the base plate 110 and processed by manufacturing equipment, e.g., stamped by the stamping tool 100. The handling plates 101 may be made of any desired material, such as a metal or other rigid material to facilitate handling of the tuft carrier 50 when engaged with the handling plate 101, as well as to promote reusability of the handling plate 101 for multiple stampings or other manufacturing processes.

Figure 8A:
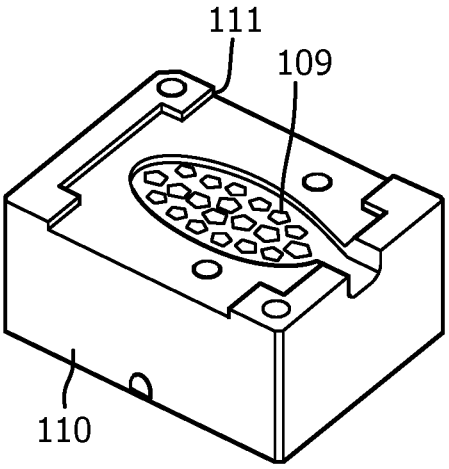
FIGS. 8A and 8B show a perspective view and a perspective cross-sectional view of a base plate according to one embodiment disclosed herein.
Figure 8B:
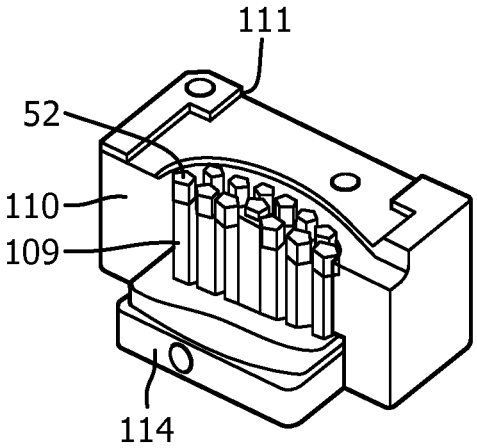
Figure 9:
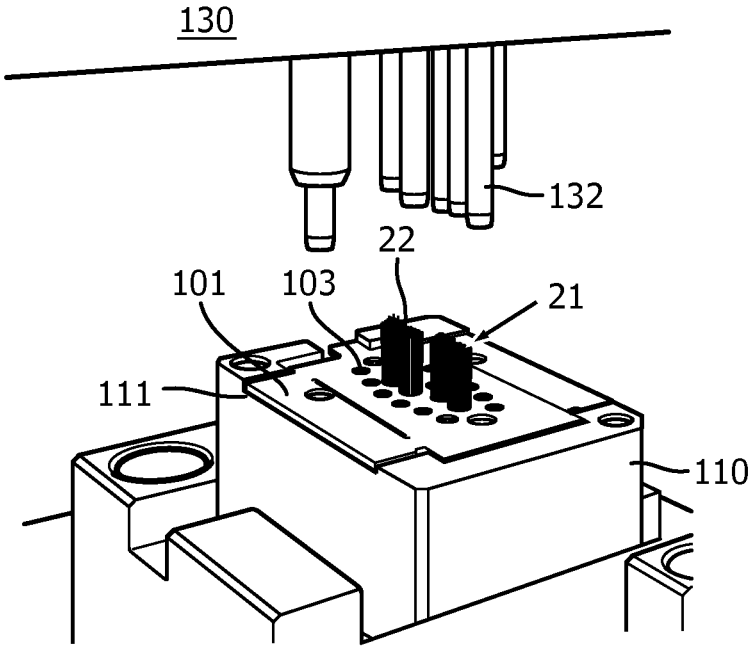
FIG. 9 shows a base plate loaded in a tufting unit according to one embodiment disclosed herein.

One embodiment for a base plate 110 is shown in FIG. 8A and cross-sectionally in FIG. 8B. The base plate 110 includes a recessed area 111 configured to receive the handling plates 101 or other manufacturing plates as discussed herein (as shown in FIG. 9). In this way, according to one embodiment, the base plate 110, together with the handling plate 101 placed in the recessed area 111, can be used during stamping to stamp the retention elements 52 directly into corresponding openings 109 in the base plate 110.

The base plate 110 in FIG. 8B is also illustrated having the retention elements 52 already inserted in the openings 109, via stamping as discussed above, or by some other process such as manual insertion. As noted above, the tuft carrier 50 may comprise individual retention elements 52, such as shown in FIG. 8B, or the tuft carrier 50*b*, 50*c*, may comprise a plurality of the retention elements 52 connected by the carrier plate 54, of the tuft carrier 50*d*, 50*e*, 50*f*, may comprise a plurality the retention elements 52 connected by webbing links 55.

As shown in FIG. 8B, the base plate 110 has openings 109 that correspond to each of the openings 51 in the retention elements 52. Note that the diameter or dimensions of the openings 109 may be configured such that the retention elements 52 are held by the base plate 110 in a desired position (e.g., the openings 109 may be tapered from top to bottom). The configuration of the openings 109 is useful for defining the shape, length, configuration, and cross-sectional shape of the bristle tufts 21 that will be inserted during subsequent steps of the manufacturing process. As discussed in more detail below, the base plate 110 may include an adjustment feature configured to assist in defining the length and/or contour of the free ends 25 of the bristle tufts 21, such as a contour insert 114.

Figure 10A:
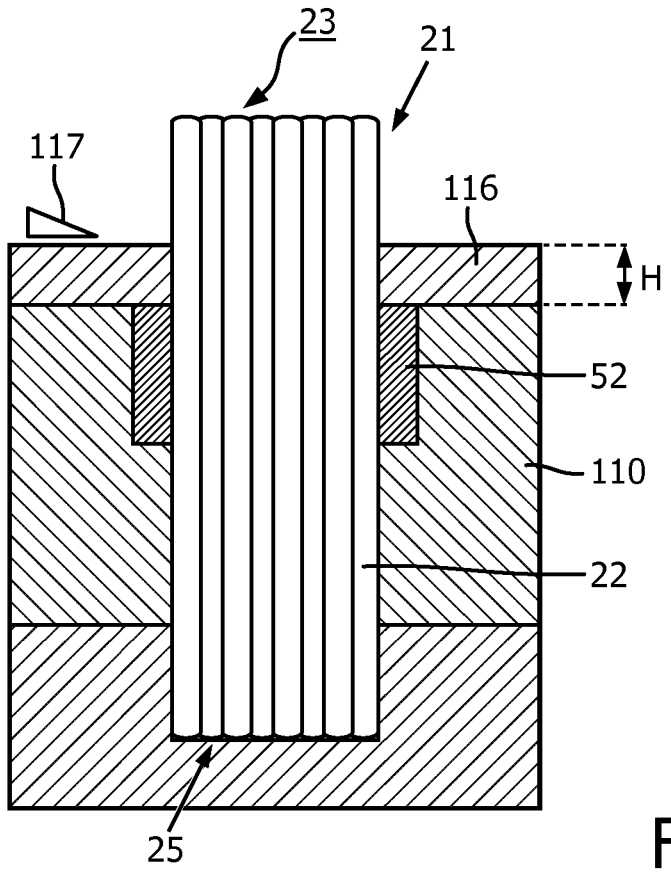
FIGS. 10A and 10B are cross-sectional views of a bristle tuft before and after a proximal end of the bristle tuft is trimmed.

FIG. 9 illustrates a tufting unit 130 according to one embodiment. The tufting unit 130 may be provided operated to form a plurality of the bristle strands 22 into the bristle tufts 21, which are inserted into each of the plurality of openings 51 in the retention elements 52, as shown in FIG. 10A. For example, as shown in FIG. 9, the tufting unit 130 may include a tuft inserter 132 that can be aligned with a corresponding openings 103 in a handling plate 101 that is inserted in the base plate 110 (e.g., held in the recessed area 111). The die block or handling plate 101 includes a plurality of openings 103 therethrough. The openings 103 in the handling plate 101 are aligned with the openings 51 in the tuft carrier 50, and the openings 109 in the base plate 110. When the various openings 103, 51, 109 in the handling plate 101, tuft carrier 50 and base plate 110 are aligned, in operation, the tufting unit 130 forcibly injects the bristles therein (e.g., mechanically, via pressurized air, etc.) to form bristle tufts 21 of a shape and size that corresponds with the openings. It is to be appreciated that the handling plate 101 may be a die plate, a guide plate, or a different plate. It is noted that tufting may occur prior to the aforementioned stamping or cutting of tuft carriers, if desired.

As can be appreciated, the bristle tufts 21 must be of the proper shape, size, and diameter to fit into each respective opening. The ends of the bristle tufts 21 that are inside the base plate 110, as shown in FIG. 10A, will become the free end 25 of the bristle tufts 21 in the brush head assembly 10, while the portion of the bristle tufts 21 that project above the base plate 110, such as shown in FIG. 9, will become the proximal end 23 of the bristle tufts 21.

Figure 10B:
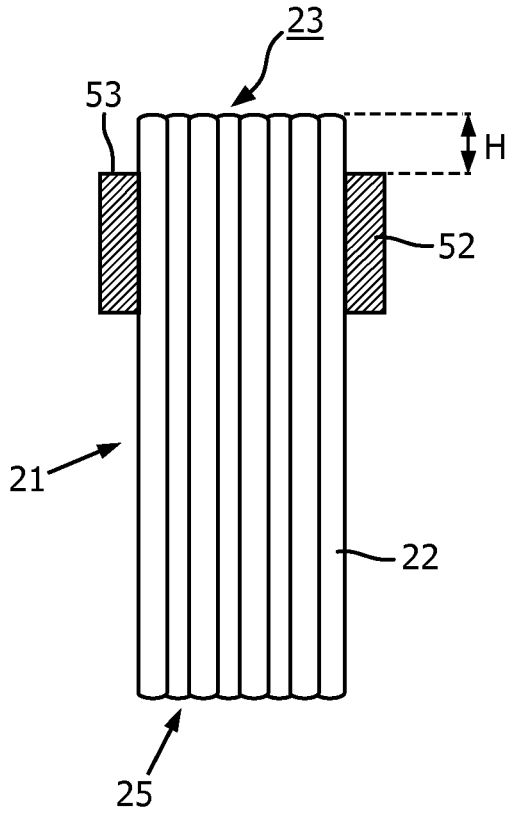

After tufting, the proximal ends 23 of the bristle tufts 21, may optionally need to be trimmed to a uniform height to ensure a proper sealing during the subsequent bonding step. To perform trimming, as shown in FIG. 10A, a cutting plate 116 having a height H can be placed in the recess 111 on the base plate 110 at the proximal end 23 of the tuft 21. The cutting plate 116 may be the same plate as the handling plate 101, or may be a different plate. A knife or cutting implement 117 can be used to trim the length of the bristle tuft 21 by removing the excess portion of the bristle tuft 21 protruding above the plate 116. In this way, as shown in FIG. 10B, the length of bristle tuft 21 extending out from a proximal side 53 of the retention element 52 will approximately equal the height H of the plate 116 when the plate 116 is removed. For example, this preset length of the proximal end 23 of the bristle tuft 21 can be useful to assist the consistent and predictable creation of the proximal end head portion 26 during bonding.

Figure 11A:
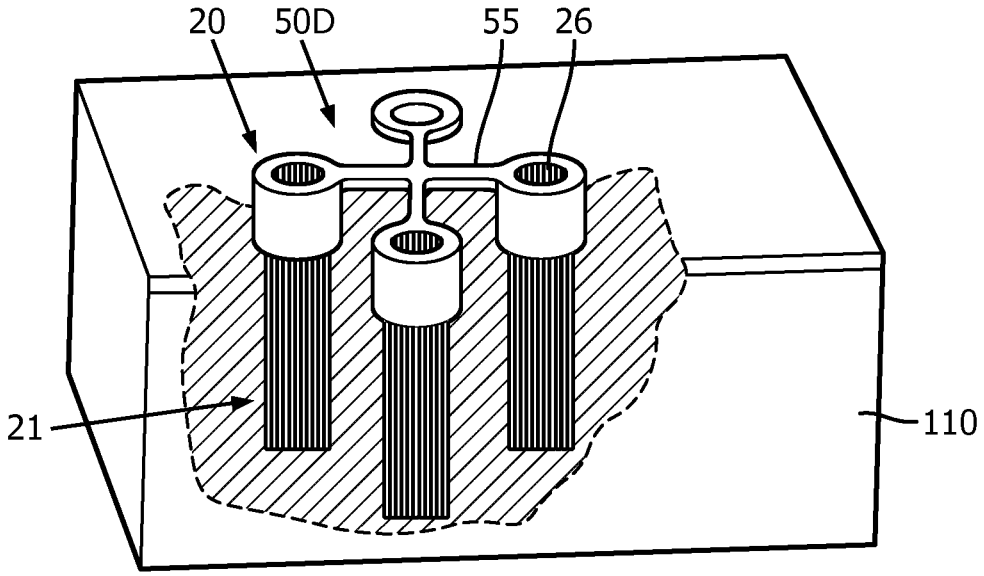
FIGS. 11A-11C illustrate tuft carriers after insertion and bonding of bristle tufts according to various embodiments disclosed herein.
Figure 11B:
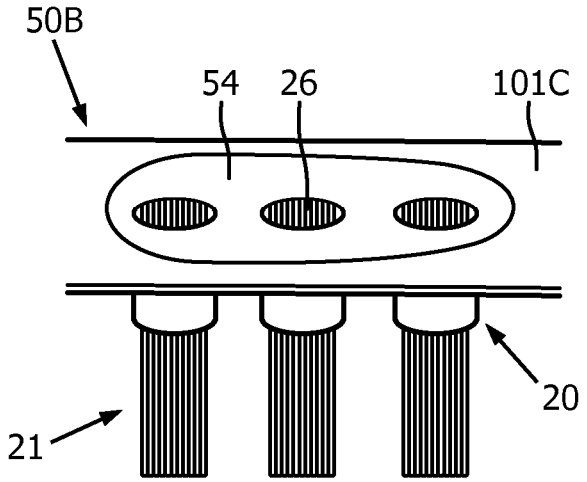
Figure 11C:
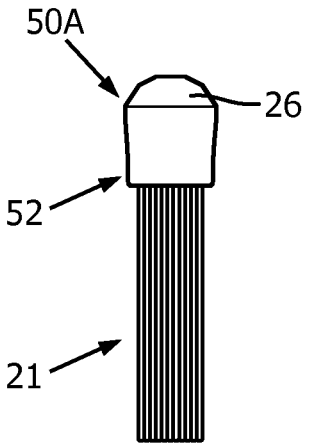

After tufting, the proximal ends 23 of the bristle tufts 21 can be bonded to the proximal side 53 of retention elements 52, e.g., by melting, welding, adhering, or other technique, to form the merged proximal end head portion 26 as noted above with respect to FIGS. 2A-2B and also shown in FIGS. 11A-11C. Three different examples of the tuft carriers 50 after tufting are shown in FIGS. 11A-11C. More particularly, FIG. 11A illustrates the tuft carrier 50D tufted with the bristle tufts 21, which extend into openings of the base plate 110. FIG. 11B illustrates the tuft carrier 50B tufted with the bristle tufts 21 while carried by the handling plate 101C. FIG. 11C illustrates the tuft carrier 50A (a single one of the retention elements 52) with the bristle tuft 21 melted to form a merged proximal end head portion 26 from at least a portion of the bristle tuft 21 and a portion of the proximal end of the retention element 52.

In one embodiment, bonding is accomplished by melting the bristle strands 22, alone or together with a portion of the retention element 52. Heat can be supplied by a heat source that comes into direct physical contact with the proximal end 23 of the bristle tufts and/or the proximal side 53 of the retention elements 52, such as a laser. Alternatively, the heat can be supplied by heated air or any of a variety of other heat sources that can be in direct physical contact, merely adjacent, or directed. As noted above, forming the bristle strands 22 and the retention elements 52 from the same or a similar material composition, may advantageously improve bonding by utilizing a same or similar melting point.

Figure 12A:
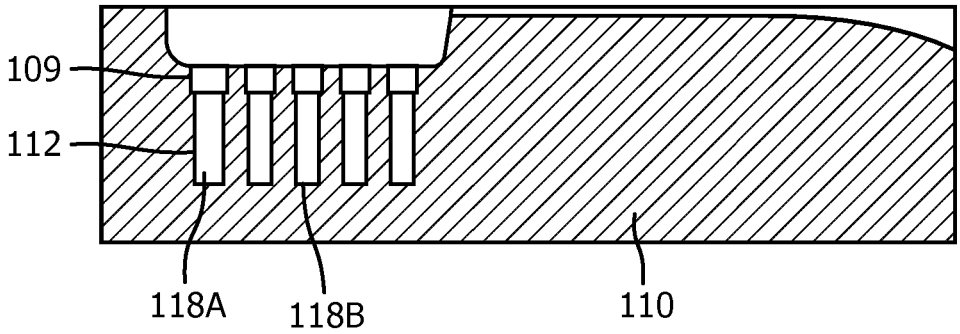
FIGS. 12A-12C illustrate a base plate having features for adjusting the free end of inserted bristle tufts according to various embodiments disclosed herein.
Figure 12B:
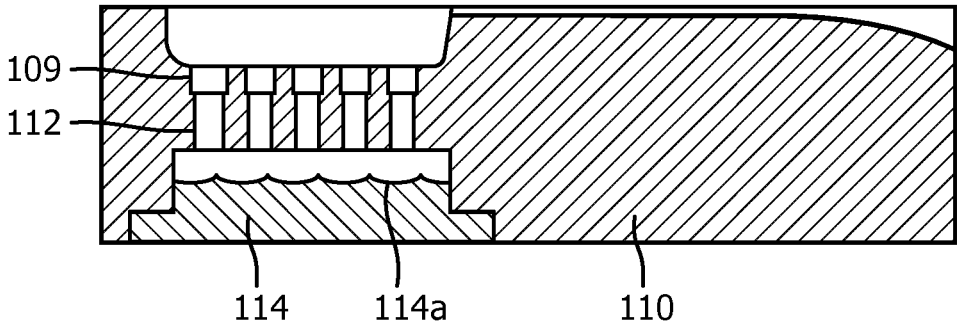
Figure 12C:
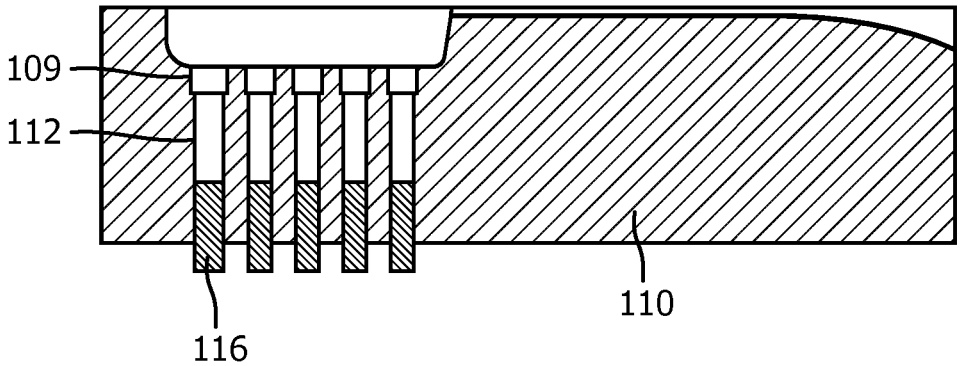

Several embodiments of features to enable adjustment of the characteristics of the free end 25 of the bristle tufts 21 can be appreciated in view of FIGS. 12A-12C. In FIG. 12A, tuft bores 112 are arranged as blind holes that terminate within the base plate 110. As discussed above, the bottom surface of the blind holes can be set as a predefined distance from openings 109, in which the retention elements 52 are be seated during tufting. That is, the bottom of each blind hole provides a stop for the portion of the bristle strands 22 that will ultimately become the free end 25 of the bristle tufts 21 in the completed brush head so that the bristle tufts 21 are maintained at the proper length during the manufacturing process. The blind holes also support the bristle strands 22 during the manufacturing process when the bristle strands 22 are inserted (e.g., via the tufting unit 130). In addition to length, the tuft bores 112 arranged as blind holes can be set to different shapes, sizes, or contours. For example, a first blind hole 118A is illustrated as slightly larger in diameter than the others, while a second blind hole 118B is illustrated as slightly shorter than the others and with a curved bottom surface to create a curved contouring for the free end 25 of the bristle tuft 21 that is inserted into the blind hole 118B.

The base plate 110 in FIG. 12B is illustrated as including a contour insert 114 also shown in FIG. 8B. As previously noted, the contour insert 114 may be used to define the shape of the free end 25 of the bristle tufts 21 in the brush head assembly 10. For example, the contour insert 114 shown in FIG. 12B would generate a finished brush head that has a shape of bristle tufts that vary in length and surface angle, as set by the tufts 21 engaging against a surface 114*a* of the contour insert 114. It can be appreciated that other shapes, such as a flat brushing surface, e.g., in which the free ends 25 of all the bristle tufts 21 project out the same distance, can also be achieved, based on the shape of the contour insert 114 that is used. The contour insert 114 may be arranged as a removable and interchangeable component so a variety of desired shapes of completed brush head bristles can be achieved with the same base plate 110.

In another arrangement shown in FIG. 12C, each of the tuft bores 112 may be provided with a pin 116 of the same shape and diameter as the tuft bores 112. For example, the pins 116 may be movable within the tuft bores 112 to enable the length of the tuft bores 112 to be adjustably set. Pins having different surface angles can be included to change the contouring of the brushing surface resulting from the free ends 25. Thus, it is to be appreciated that the pins 116 generally serve the same purpose and function as the contour insert 114 and the blind holes 118, e.g., to form the desired shape, length, and contours of the bristle field and/or brushing surface of the completed brush head.

Figure 13A:
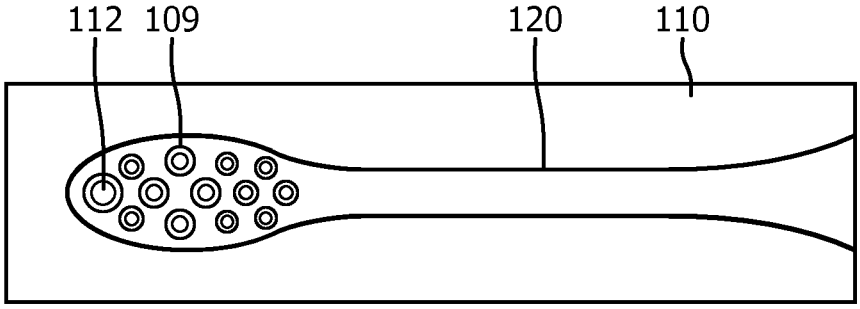
FIGS. 13A-13C illustrate a top view and two cross-sectional views of various stages of manufacturing a brush head using a base plate according to one embodiment disclosed herein.
Figure 13B:
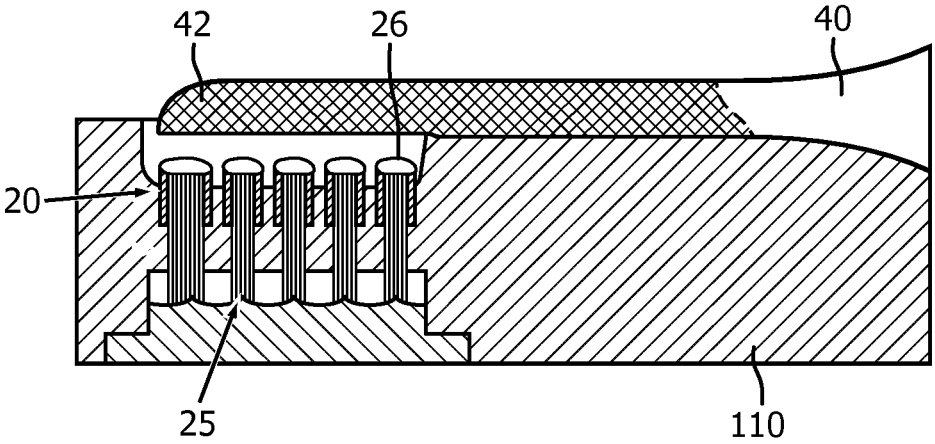
Figure 13C:
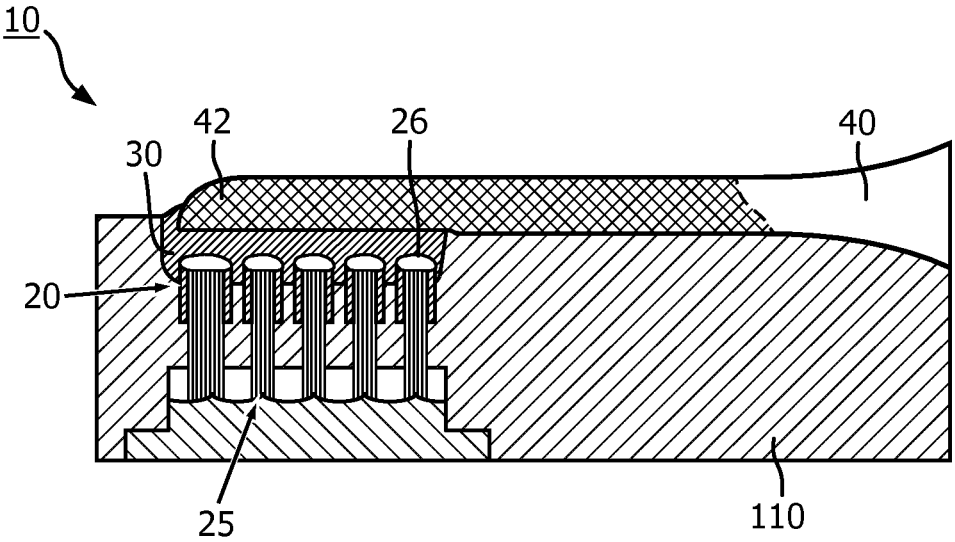

Final assembly of the brush head 10 can be appreciated in view of FIGS. 13A-13C. FIG. 13A shows a top view of the base plate 110 having the tuft bores 112 and the recesses 109 formed therein as described above, i.e., for receiving the bristle tufts 21 and the retention elements 52, respectively. In this way, after stamping, tufting, bonding, etc., the merged tuft assemblies 20 are fully formed, and can be positioned with the retention elements 52 in the recesses 109 and the free ends 25 of the bristle tufts 21 in the tuft bores 112.

The base plate 110 may also include a recess or cavity 120 in the general shape of the brush head 10 neck 40 and/or the matrix 30. After the merged tuft assemblies 20 are are created and positioned in the base plate 110, the neck 40 may be positioned to align the platen 42 in relation to the merged proximal end head portions 26 of the merged tuft assemblies 20. For example, as shown in FIG. 13B, the cavity 120 may properly align the platen 42 of the neck 40 with the tuft assemblies 20 when the neck 40 is placed in the cavity 120. Additionally, any desired prefabricated parts (e.g., electronic parts, additional rings, springs, or any other components) can be added and held in position by the base plate 110 during this step of manufacturing. Any such parts can be molded into the final brush head as described in subsequent steps herein.

Figure 14A:
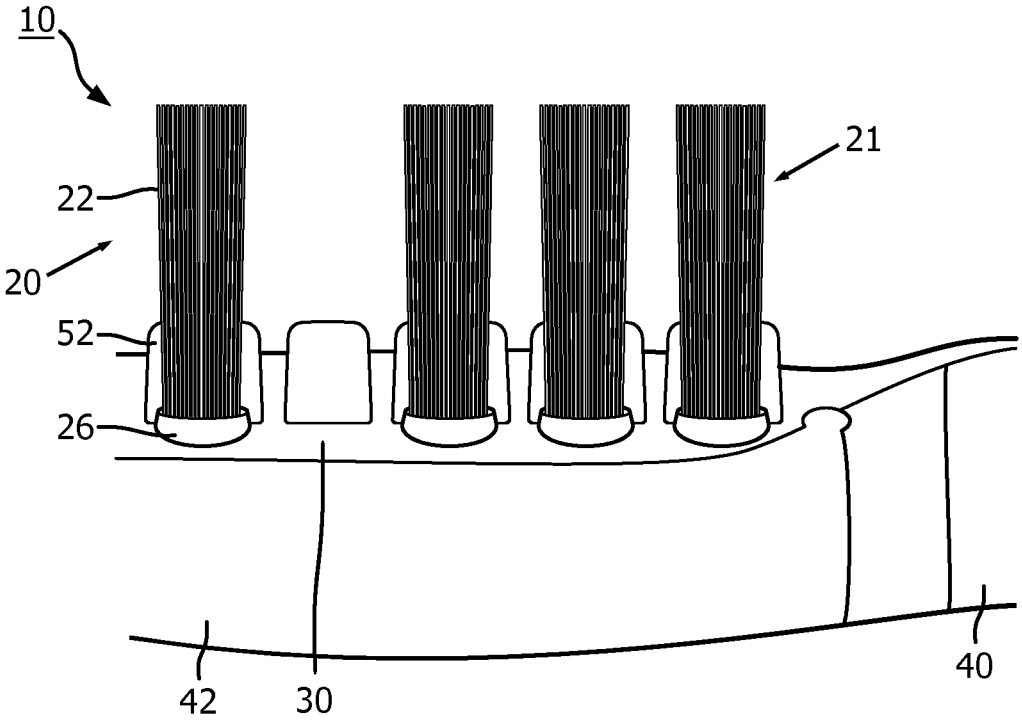
FIGS. 14A and 14B are a cross-sectional side view and a side view of brush head assemblies according to embodiments disclosed herein.
Figure 14B:
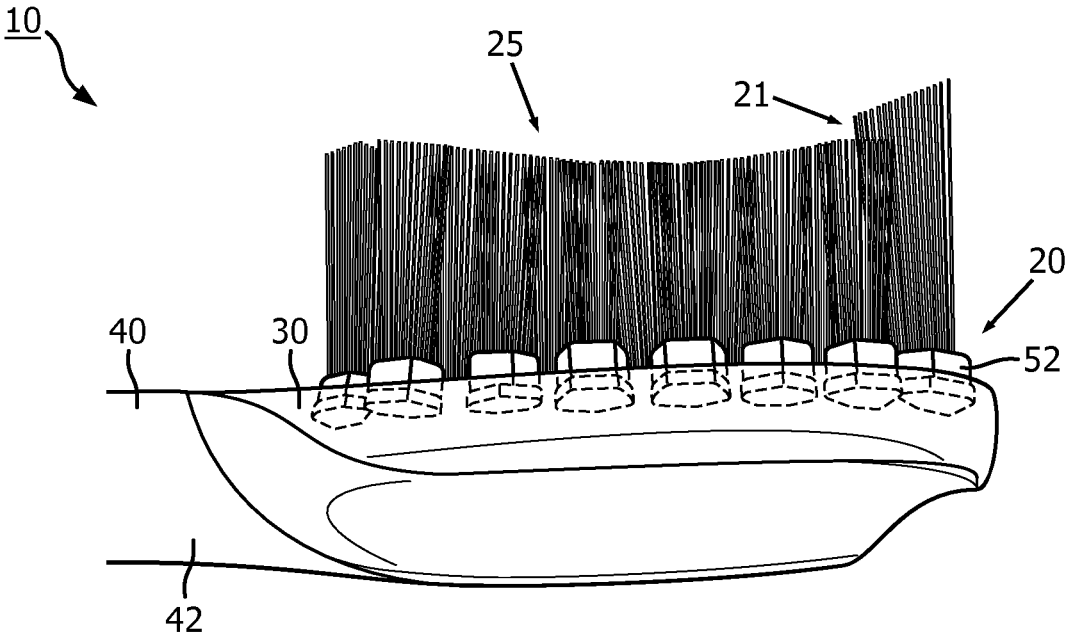

Thereafter, the components may be overmolded by the matrix 30 by injecting material, e.g., in a liquid or flowable state, into the space formed between the platen 42 and the merged proximal end head portions 26 of the merged tuft assemblies 20. The matrix 30 solidifies to secure the neck 40 and the tuft assemblies 20 together by at least partially encompassing or encapsulating the platen 42 and the tuft assemblies 20, as shown in FIG. 13C, thereby forming the brush head assembly 10. According to an embodiment, the matrix 30 is preferably made from an elastomeric material such as a flexible thermoplastic elastomer (TPE) or silicone rubber. It is to be appreciated that in one embodiment the neck 40 is not provided as a pre-formed member, but instead that the matrix 30 and the neck 40 are formed at the same time and by the same material by injecting a suitable material into the cavity 120. FIGS. 14A and 14B respectively illustrate additional examples of the brush head 10 when completed.

Figure 15:
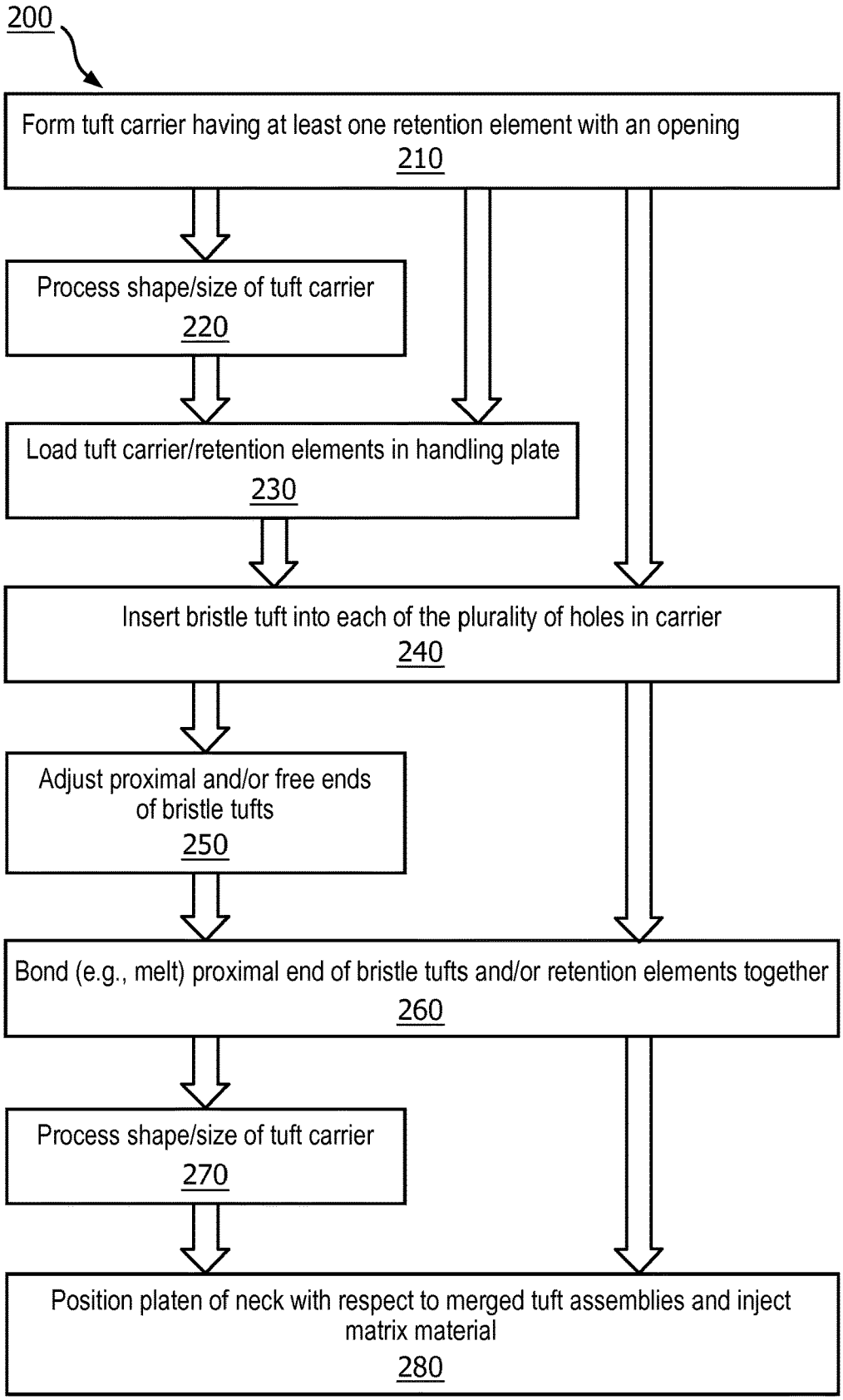
FIG. 15 is a flow chart illustrating a method of manufacturing a brush head according to one embodiment disclosed herein.

Referring to FIG. 15, in one embodiment, is a method 200 for manufacturing one or more of the various brush head embodiments 10 and implementations described or otherwise envisioned herein. In step 210, a tuft carrier 50 is formed, such as by molding by any known molding process.

The tuft carrier includes one or more retention elements 52 having an opening 51 formed therethrough.

In step optional 220 of the method 200, the tuft carrier may be processed to alter, set, or define the size or shape of the tuft carrier, or the retention elements or openings therethrough. For example, the tuft carrier may be stamped or cut to remove excess material 59. For example, the tuft carrier may be a carrier plate 54 further processes so that one or more webbing links 55 that are formed, shaped, resized, or removed in the step 220 (e.g., with the stamping tool 100, the handling plate 101, or as otherwise discussed with respect to FIGS. 4-7B).

At step 230, the retention elements of the tuft carrier, either directly after formation in step 210, or after processing in step 220, are positioned in corresponding recesses 109 of a handling plate 110. In one embodiment, the steps 220 and 230 are essentially combined in that the retention elements are directly stamped into the recesses of the handling plate simultaneously as the excess material is removed (as discussed with respect to FIGS. 4-7B).

At step 240 of the method 200, bristles are arranged in tufts and inserted (e.g., via the tufting unit 130) through the openings 51 in the retention elements 52. At optional step 250, a proximal end 23 and/or a free end 25 opposite to the proximal end of the bristle tufts 21 may be adjusted in length, shape, size, contour, etc. For example a base plate may include an adjustment feature such as an insert having a contoured surface 114, or blind holes 118 and pins 119 for receiving and setting the contour of the free ends. The proximal ends of the bristle tufts may optionally be cut or trimmed to achieve a desired height using a cutting plate 116 and a knife or cutting implement 117.

At step 260 of the method, the proximal end 23 of the bristles 22 of the bristle tufts 21 are bonded together and/or bonded to at least a portion of the proximal side of the retention element 50 to form a merged proximal end head portion 26. Once secured together by the merged proximal end head portion 26, each corresponding pair of the bristle tufts and the retention elements form a merged tuft assembly 20. In one embodiment, bonding is achieved by applying heat to the proximal end of the bristle tufts and the retention elements to melt the components together. The heat can be supplied by a heat source that comes into direct physical contact with the proximal end of the bristle tufts and/or the retention elements. Alternatively, the heat can be supplied by heated air or any of a variety of other heat sources that can be in direct physical contact, merely adjacent, or directed. By making the bristle strands and the retention elements from material having the same or a similar composition, and therefore the same or similar melting point, good bonding can be facilitated.

At optional step 270, if not already done previously in the manufacturing process (e.g., at step 220), the tuft carrier can be processed to remove any excess material. For example, as discussed above with respect to step 220, this may include removing a portion or all of a carrier plate, webbing link, etc. As also discussed above, step 270 may not be performed, e.g., if the entirety of the carrier plate 54 is included in the brush head assembly 10 when fully assembled.

In step 280 of the method 200, the tuft assemblies can be inserted into the base plate (if not already installed) and a neck 40 for the brush positioned relative to the tuft assemblies. For example, this may include placing the neck in a corresponding cavity 120 of the base plate, which aligns a platen 42 portion of the neck 40 with respect to the merged tuft assemblies. After positioning, a matrix material 30 is overmolded about at least a portion of the merged tuft assemblies and the neck by injecting material into the space between the neck and the merged tuft assemblies. The matrix may include an elastomeric material. Once solidified, the matrix at least partially encompasses or encapsulates the merged tuft assemblies and the neck together, thereby forming the brush head assembly.

In accordance with embodiments disclosed and envisioned herein, it is to be appreciated that the same handling plate or base plate (101, 110) may be utilized for multiple different manufacturing steps, such as molding, stamping, tufting, bonding, trimming/adjusting bristles, and/or overmolding. In other embodiments, partially-manufactured components may be transferred from one handling plate or base plate to a different handling plate or base plate. Additionally, it is to be appreciated that each of the steps in method 200 are optional and/or may be completed in an order other than that shown. Advantageously, these features enable flexibility in the time and location for any of the manufacturing steps, while also permitting each step to immediately follow the next if desired.

As noted herein, laser welding may be particularly advantageous in some embodiments for bonding the bristles and retention elements together. Laser welding will consume at least a portion of the proximal end 23 of the bristles 22 as well as adjacent portions of the retention elements 52 in forming the merged proximal head portion 26 as a completely sealed unitary element. The laser welding can accordingly be operated at some pre-specified performance characteristics (e.g., laser beam wavelength, resultant temperature of the heated materials, pulsation frequency or duration of continuous operation, beam diameter, speed at which the beam is moved across the proximal end 23, etc.) to melt the corresponding materials to a predictable depth and/or with a predictable depth profile(s) across the width (lateral/radial direction) of each of the tuft assemblies 20.

Laser welding operations may be configured with respect to one or more weld zones. The weld zones may include a first weld zone adjacent the proximal side 53 of the retention element 52, in which only material from the retention element 52 is melted and reformed, i.e., without integrating any of the bristle strands 22 therein. A second zone may be formed laterally or radially inward of the first zone, in which both a portion of the retention element 52 and the bristle strands 22 are melted and integrated together. A third zone may be formed where only the bristles 22 are melted and integrated together, i.e., without integrating any material from the retention element 52.

If compatible materials are used, the second zone can advantageously fuse together materials from both the retention elements 52 and the bristles 22 and assist in integrating the first and third zones together as a continuous, unitary, sealed structure, e.g., the merged proximal head portion 26. Any of the weld zones discussed above may be formed to preselected dimensions (e.g., lateral distance and/or longitudinal depth) and/or with some preselected dimensional profile(s) in the corresponding zone, e.g., a gradient laterally/radially across the tuft assembly 20 and/or across any of the zones. The third zone (including just the material from the bristles 22) is expected in many embodiments to be the largest zone, depending on the cross-sectional size of the tufts 21 and the thickness of the retention elements 52.

The selected welding energy or energies, the area/volumes to which the energy/energies are directed, the duration the energy/energies are applied, and other parameters may be varied across the tuft 21 or the tuft carrier 50 and/or across a particular tuft of a particular retention element 52 of the tuft carrier 50. As to any carrier, the parameters of the welding may be configured so as to provide strong, complete, sealed and otherwise desired welds for each tuft-retention element. For example, particular welding parameters may be adjusted to respond to one or more of various factors, such as: (a) desired shape/dimensions of a weld to set a tuft retention force enabled by the weld and other structural and performance goals relating to the weld; (b) a tuft's shape, dimensions, size, etc.; (c) a tuft carrier or retention element shape, dimensions, size, etc.; (d) alignment/orientation of a tuft with respect to its retention element (e.g., the distance(s), such as the height H, that filaments protrude from the proximal end of the retention element); (e) the alignment/orientation of the tuft carrier or tuft-retention element to the platen, e.g., to set performance characteristics of the tufts after final assembly of the brush head; (f) filament(s) shape, structure(s), type, materials, etc.; and/or (g) the carrier/retention element's shape, structure(s), type, materials, etc. The welding configuration may be optimized, e.g., to arrive at desired and proper welds in a minimum or otherwise desired amount of time, or energy (e.g., to minimize or prevent burning or other activity that might change the nature of the weld or any material).

One or more selected welds may be performed by introducing an auxiliary material to selected area of the welding. As an example, an auxiliary material may be introduced at the proximal end of selected or all filaments so that, with welding, a weld is provided that combines the bristles 22 with the auxiliary material and the retention element 52 in locations sufficiently proximate to the retention element 52. The introduction of the selected material may be accomplished by applying the auxiliary material, e.g., as a thread, powder, liquid, etc. to the welding area in a selected mass or volume during welding. The auxiliary material may be the same or similar material as the bristle strands 22, or the retention element 52, some combination of these, or neither of these.

Figure 16:
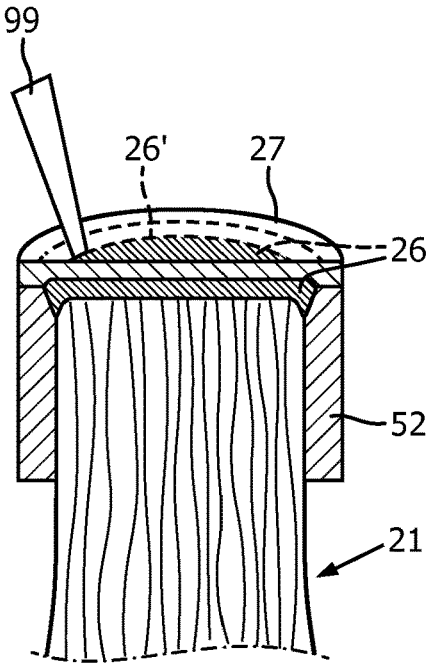
FIG. 16 is a perspective schematic representation of a merged tuft assembly having a cap and of a laser welding process using a transparent component.

In one embodiment, for example, as shown in FIG. 16, one or more plates, caps, coverings, coatings, or other solid volumes comprising a defined amount of an auxiliary material may be applied on, over, or adjacent the selected area(s) for welding. For example, in the case of a plate, its selected area may provide for it to extend beyond the tuft perimeter (e.g., laterally or radially) so as to cover the merged proximal end head portion 26. In this way, after welding, the plate forms a cap 27, as shown in FIG. 16, which covers all, or substantially all, of the merged proximal end head portion 26 of the retention element 52 and the tuft 21 after welding. By this or other manner of introducing auxiliary material across the intended welding area, for example, the seal provided by the welding may be enhanced, e.g., so as to impede or prevent incursion of other materials between the bristles 22 and/or the retention element 52 during subsequent overmolding or other assembly processes.

In one embodiment, the laser welding process is performed using a plate or material that is transparent to the beam of the laser. In this transmission welding technique, the laser may pass through the plate so as to weld the tuft and retention element and, in so doing, generate thermal energy sufficient to join the plate to the retention element 52 and/or the tuft 21. The plate may be placed over the merged proximal end head portion 26 with clamping pressure applied. For example, referring to FIG. 16, the cap 27 may be made from a material that is transparent to a beam 99 from a laser device, such that the beam 99 passes through the cap 27 and melts the bristle tuft 21 and/or the retention element 52 together at an outer surface 26' of the merged proximal end head portion 26. The heat generated at the outer surface 26' can be sufficient to also bond the cap 27 to the bristle tuft 21 and/or the retention element 52, thereby sealing and/or forming a part of the merged proximal end head portion 26.

Figure 17:
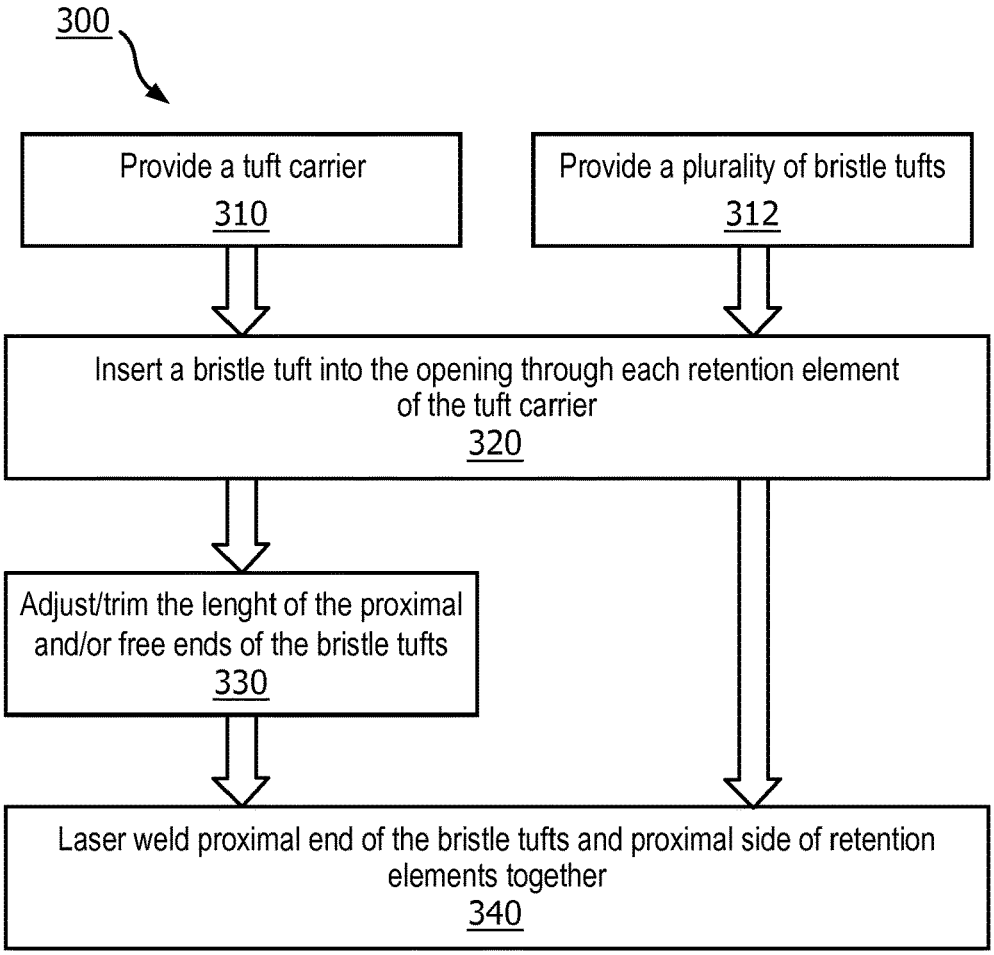
FIG. 17 is a flowchart of a method for manufacturing a brush head assembly with bristle tufts retained in a retention element in accordance with an embodiment.

Referring to FIG. 17, in one embodiment, is a method 300 for manufacturing merged tuft assemblies 20 according to the embodiments and implementations described or otherwise envisioned herein. It is to be understood that the steps of the method 300 may be generally interchanged, or inserted, as applicable, with or between the steps of other methods disclosed herein, such as the method 200. Likewise, the steps of other methods disclosed herein may be interchanged and/or inserted into the method 300. In step 310 of the method 300, a tuft carrier 50 comprising one or more retention elements 52 is provided. At step 312 of the method 300, a plurality of bristle tufts 21 are provided, each of which comprises a plurality of bristle strands 22.

At step 320 of the method 300, at least one of the bristle tufts is inserted into an opening 51 of each of the retention elements of the tuft carrier. At step 330, the length, contouring, or configuration of a proximal end 23 or a free end 25 of the bristle tufts may be trimmed or otherwise adjusted (e.g., as discussed with respect to step 250 of the method 200).

At step 330, a laser is utilized to weld the proximal end of the bristle tuft, or the proximal end of the bristle tuft and at least a portion of the proximal side 53 of the retention element together. When cooled or otherwise solidified, the laser welding creates a proximal head portion 26. Step 330 may include adding an auxiliary material (e.g., the cap 27) to assist in creating or sealing the weld.

After the proximal end head portion of the welded tuft assembly has been formed and allowed to cool, the welded tuft assembly can be further processed, either immediately thereafter or at another place and time. For example, in one embodiment, the welded tuft assemblies can be positioned relative to a neck of a brush head (e.g., the neck 40) and overmolded, together with the neck, by a matrix (e.g., the matrix 30) to form a completed brush head (e.g., the brush head 10).

Figure 18:
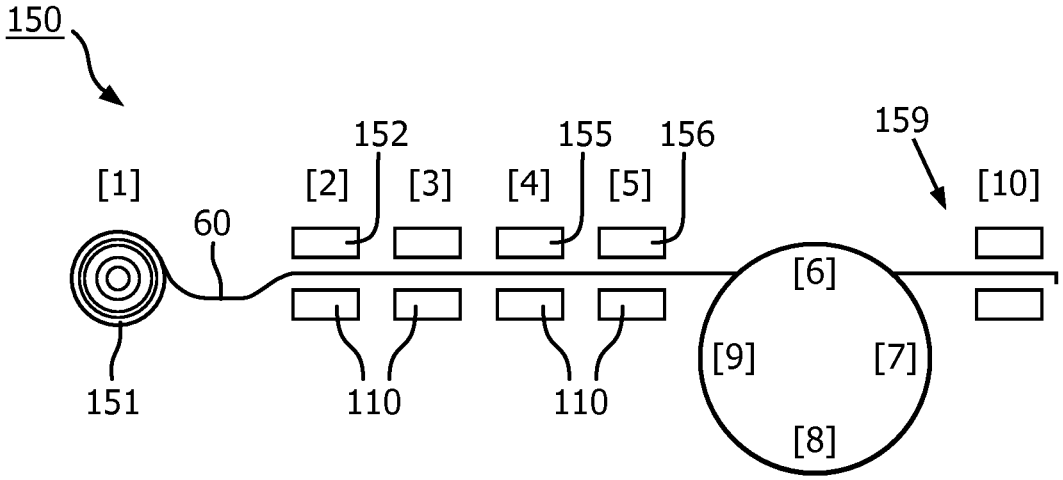
FIG. 18 schematically illustrates a production line for manufacturing a brush head according to one embodiment disclosed herein.

As noted herein, the tuft carriers 50 may be formed by stamping. Accordingly, a manufacturing production line 150 for manufacturing brush heads, e.g., the brush head 10, utilizing stamping is illustrated in FIG. 18. Various steps or stages employed by the production line 150 are also best appreciated in FIGS. 19A-19E, which are marked with the corresponding stage number from FIG. 18 in brackets. At stage [1], the production line 150 is provided with a backing material 60 in a blank form. The backing material 60 may be provided from a roll 151, or in some other form such as a strip 151*a*, plate, etc. (not shown). As discussed in more detail below, the backing material 60 may have a width and thickness sufficient from which to produce the retention elements 52. The backing material 60 may be formed as a length of material such that retention elements 52 for a number of brush heads may be successively produced from the same piece of backing material, e.g., as the backing material 60 is unspooled from the roll 151, or a strip of backing material 151*a* (not shown) is fed to the manufacturinc equipment. In some arrangements, the backing material 60 may have one or more guide holes 61 to assist in transitioning the backing material 60 between the different pieces of manufacturing equipment, and/or to keep the backing material 60 at the proper position and tension on the manufacturing equipment, e.g., by engaging the holes 61 with corresponding pins of the manufacturing equipment.

Figure 19A:
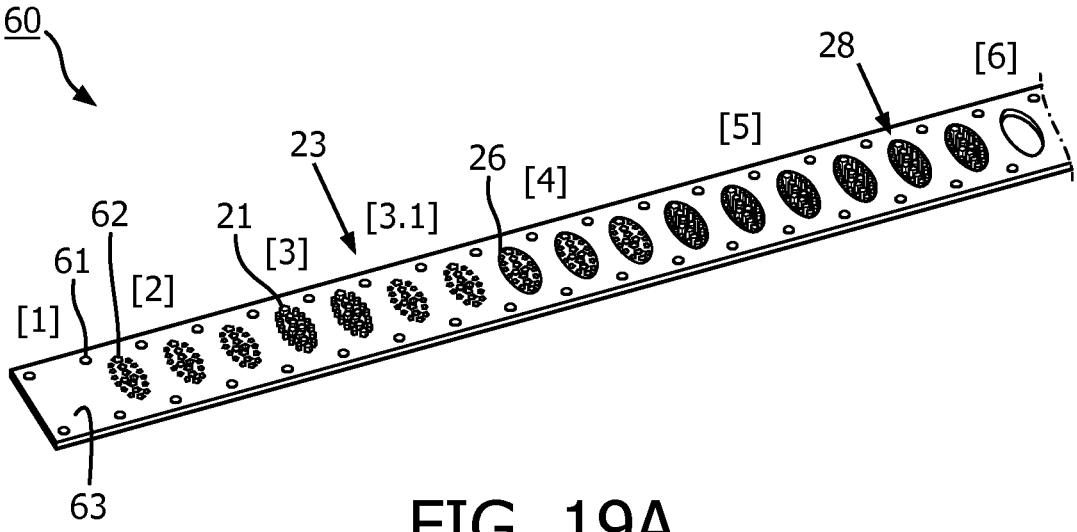
FIGS. 19A-19E illustrate a strip of backing material and resultant components at various manufacturing stages according to one embodiment disclosed herein.
Figure 19B:
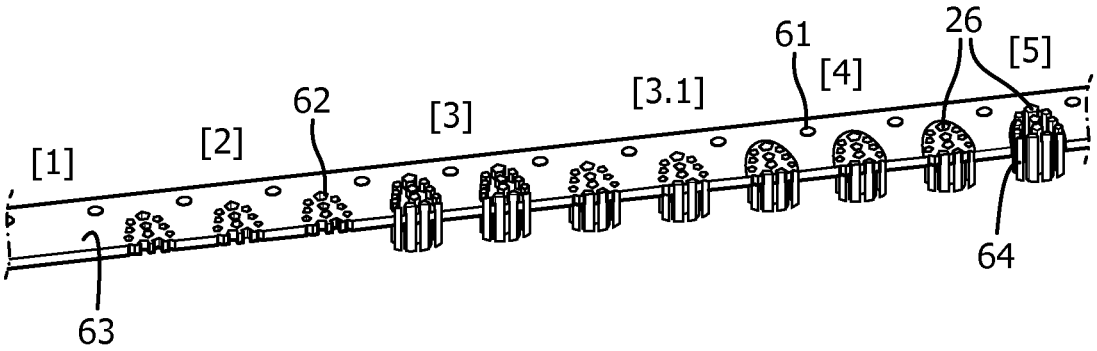
Figure 19C:
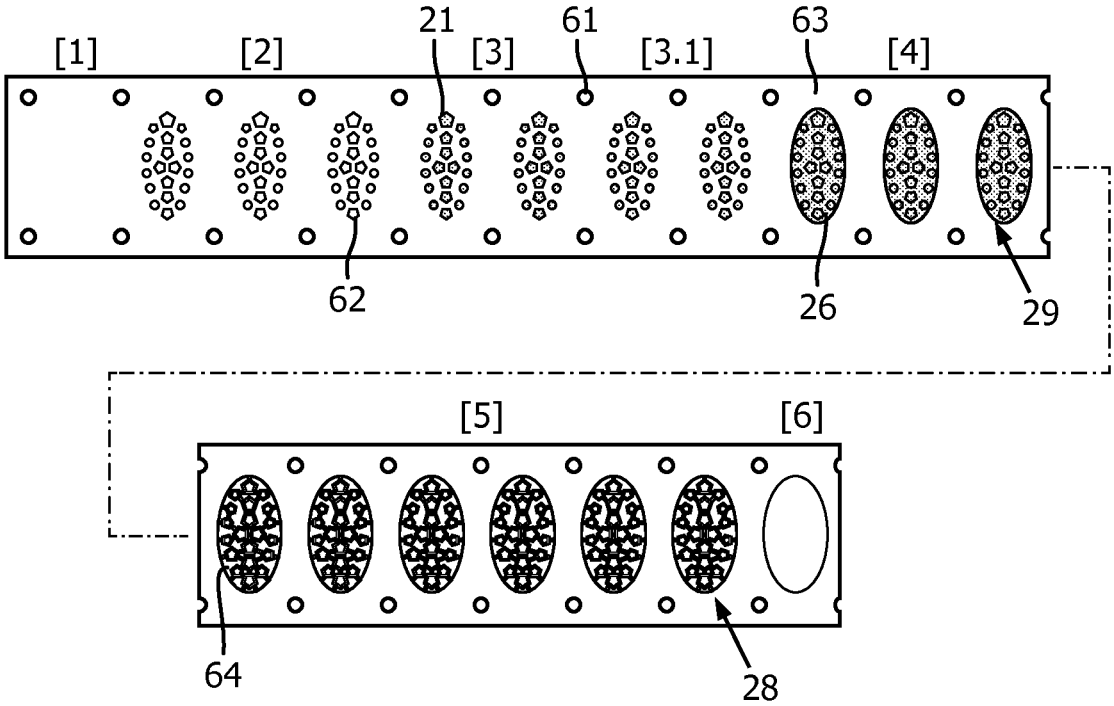

At stage [2], a plurality of openings 62 is stamped through the backing material 60. As can be seen in FIGS. 19A-19C, different sizes, shapes and placements of openings 62 can be stamped into the backing material 60. In this way, the openings 62 may each, and/or together, be arranged in sizes, shapes, and/or patterns to reflect the planned arrangement of bristles tufts 21 in the brush head assembly 10 when completed. As will be better appreciated in view of the below disclosure, the retention elements 52 are formed from the backing material 60 with each opening 62 providing a means for inserting a bristle tuft therethough so that the bristle tuft may be secured with or to through the retention elements 52. Stage [2] may be carried out using a die and/or stamping press 152. If different final bristle configurations are desired, different stamp dies can be used for the various configurations.

During stamping, the backing material 60 and/or portions thereof may be engaged in or on a mold or based plate 110. Once the backing material 60 has been stamped, it is ready for further processing, either immediately, or at a later time and/or place. If at a later time and/or place, the stamped backing material 60 can be rolled or stacked and unrolled or unstacked again later for further processing on the same or different manufacturing equipment. The backing material 60 may stay in the mold (e.g., the base plate 110) during multiple stages, or may be transferred between different molds (e.g., the base plate 110), e.g., specifically arranged for each stage, as desired.

At stage [3], one or more bristle tufts 21 are inserted into the plurality of openings 62 in the backing material 60. As can be appreciated, each bristle tuft 21 must be of the proper size to fit into each respective opening 62 and/or the size and shape of the openings 62 define the respective shape and size of the corresponding bristle tuft 21 when the openings 62 are filled with the bristle strands 22.

The proximal end 23 and free end 25 may be adjusted via any manner described herein, e.g., via a contour plate, pins, blind holes, cutting plate, knife, etc. For example, in FIGS. 19A-19B, a portion of the tufts 21 is illustrated as protruding from a proximal side 63 of the backing material 60 at stage [3], and this protruding portion is removed at stage [3.1]. In one embodiment, the protruding portion may be trimmed to a predetermined height, e.g., in order to facilitate later bonding processes, particularly melting or other processes that tend to partially consume the bristle strands 22 during bonding. The cutting or trimming of the bristles 22 may be accomplished by a knife or other cutting tool, e.g., running along the surface of the proximal side 63 of the backing material 60.

At stage [4], the proximal ends 23 of the plurality of bristle tufts 21 are bonded together, which may include bonding the tufts 21 with or to at least a portion of the surrounding backing material 60. For example, sufficient heat to melt the components together may be applied to form the merged proximal end head portion 26 as discussed above with respect to FIG. 2. Thus, it is to be appreciated that the merged proximal end head portion 26 may be formed as a combination of one or more of at least a portion of the proximal side 63 of the backing material 60 and at least a portion of the proximal end 23 of the bristle tufts 21 merged together. Bonding can be achieved using a heat source 155, such as a heated press, ram, or pin, which comes into direct physical contact with the proximal end 23 of the bristle tufts 21 and/or the proximal side 63 of the backing material 60. Alternatively, bonding cana be achieved using heated air, a welding laser, chemical fusing, or a variety of any other heat source. As noted above, in order to form a merged tuft assembly 20, the backing material 60 and bristle tufts 21 may be made of material having the same or a similar composition, such as ABS, nylon, polypropylene, or variations or combinations of these materials.

Figure 19D:
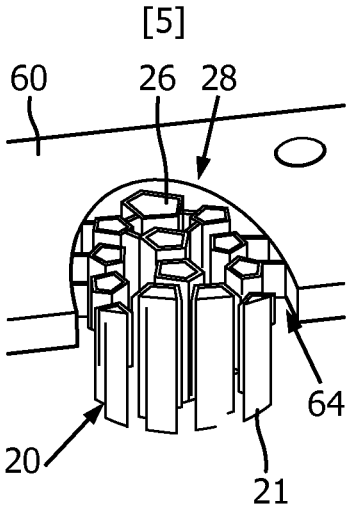

At stage [5], once the merged proximal end head portion 26 is formed (and has cooled or cured sufficiently), in one arrangement of the present invention, excess portions 64 of the backing material 60 may be removed, e.g., by stamping or cutting equipment 156 to form individual merged tuft assemblies 20. As illustrated, instead of separate merged tuft assemblies, a tuft carrier web 28 may be formed as a group of the tuft retention elements 52 interconnected by strands or webs (e.g., in the final bristle tuft pattern for the brush head 10). Enlarged versions of the tuft retention elements 52 and/or the tuft carrier web 28 at stage [5] is illustrated in FIG. 19D. Stage [5] may include a pre-cutting operation in which the tuft retention elements 52 and/or the tuft carrier web 50' is still attached to the backing material 60 via one or more strands or webs. In one embodiment of the present invention, stage [5] of manufacturing is not utilized. In this embodiment, instead of forming the tuft carrier web 28 by removing the excess portions 64, a carrier plate 29 of merged tuft assemblies is created, as best shown in FIG. 19C at stage [4]. In this embodiment, manufacturing proceeds from stage [4] directly to stage [6], and the carrier plate 29 of merged tuft assemblies is removed from the backing material, 60 as described below.

Figure 19E:
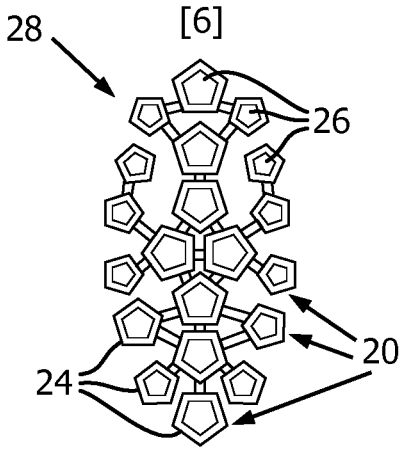

At stage [6], individual merged tuft assemblies 20 and/or tuft carrier webs 28 of merged tuft assemblies, or carrier plates 29 of merged tuft assemblies may be completely removed from the backing material 60. An enlarged view of the tuft carrier web 28 is shown in FIG. 19E. Once the completed merged tuft assemblies 20 (either separate or interconnected in the tuft carrier web 28 or tuft carrier plate 29) are separated from the backing material 60, the surplus backing material remaining on the roll can be disposed of or recycled in stage [10], as known in standard industrial recycling techniques.

In stage [7], the neck 40 is formed according to any desired known or future developed standard manufacturing technique, e.g., by molding the neck 40 from plastic using a mold. In stage [8], the neck 40 and the merged tuft assemblies 20 (e.g., separately or in one of the tuft carriers 50 such as the tuft carrier web 28 or tuft carrier plate 29) are positioned relative to each other and overmolded by the matrix 30.

It is to be appreciated that variations on the above-described manufacturing processes are possible. For example, the above-discussed steps and stages may be optionally performed, performed in a different order, or substituted for other steps or stages. In one embodiment, the backing material 60 is stamped in such a way, e.g., at stage [2], such that the excess portions 64 of the backing material 60 are removed prior to tufting. In this way, the tuft retention elements 52 and/or the tuft carrier web 50' are tufted and then bonded to the tufted bristles, instead as described above. In one embodiment, the retention elements 52, the tuft carrier web 28, or carrier plate 29 can be completely cut out of the backing material 60 (e.g., as discussed with respect to stages [5-6]), and further processing (e.g., insertion of bristle tufts in accordance to stage [3], bonding or melting in accordance with stage [4], over molding in accordance with stage [8], etc.), can be completed (e.g., after cutting them out from the backing material 60, the retention elements 52 and/or the carrier web 28 or carrier plate 29 may be maintained in the same mold until completion). In other embodiments, the partially-processed backing material 60 may be transferred between different molds or pieces of equipment at the same or different locations, facilities, and/or times.

Figure 20:
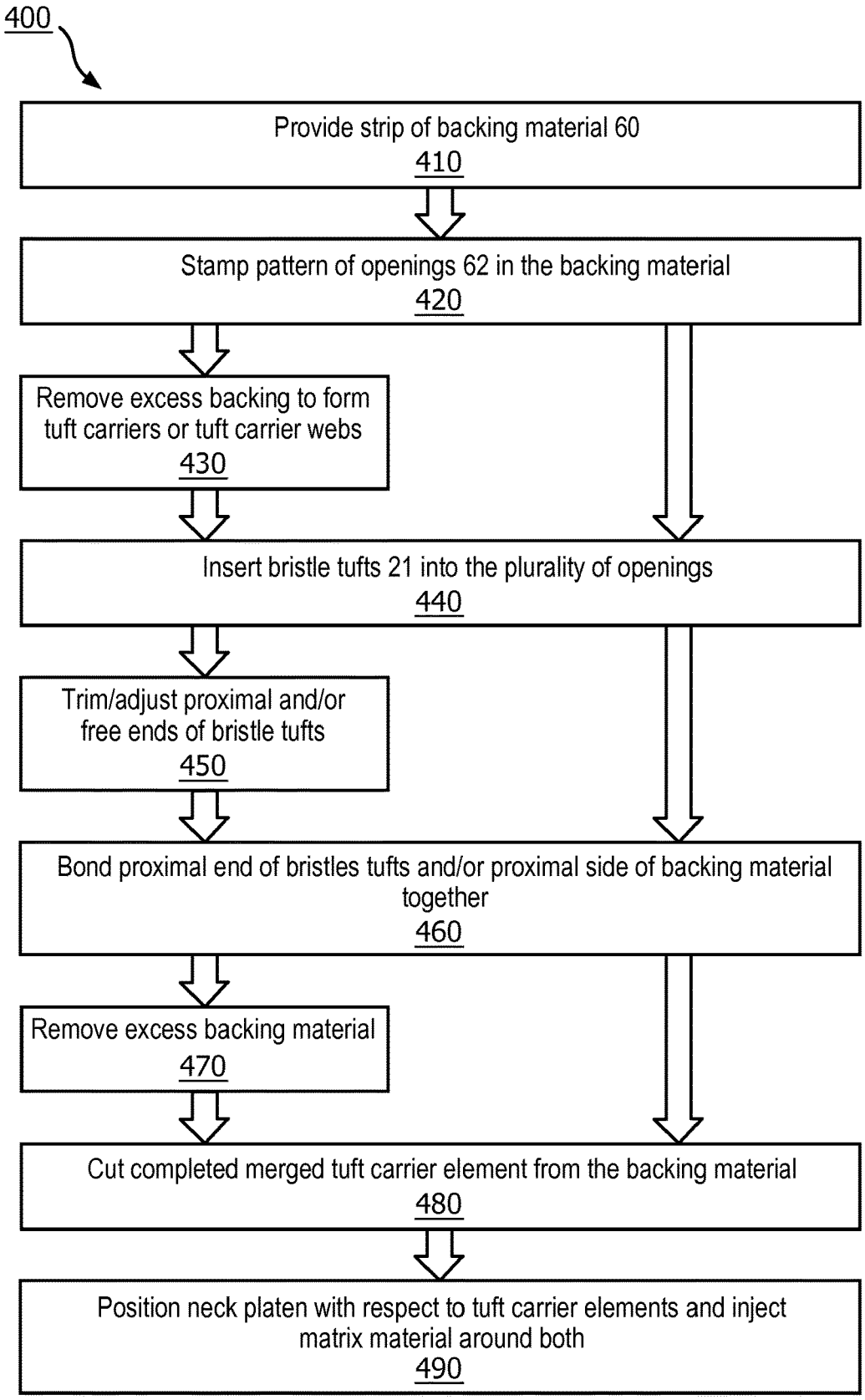
FIG. 20 is a flowchart of a method for manufacturing a brush head assembly in accordance with an embodiment.

Referring to FIG. 20, a method 400 is provided for manufacturing one or more of the various brush head 10 embodiments and implementations described or otherwise envisioned herein. As with the other methods disclosed herein, it is to be understood that the steps of the method 400 may be generally interchanged, or inserted, as applicable, with or between the steps of other methods disclosed herein, such as the methods 200 or 300. Likewise, the steps of other methods disclosed herein may be interchanged and/or inserted into the method 400.

In step 410 of the method 400, a strip 151*a* or roll 151 of backing material is provided as described with respect to stage [1] above. In step 420, a plurality of openings 62 is formed through the backing material of a size, shape and pattern to reflect the planned arrangement of bristles in the completed brush head assembly 10 as described with respect to stage [2] above).

In one embodiment, optionally, at step 430, the backing material is stamped or cut in such a way that excess portions 64 of the backing material are removed to form one or more separate tuft retention elements 52 and/or an interconnected web of tuft retention elements 28. The retention elements and/or carrier web may be completely cut out of the backing material before subsequent processing. Once the backing material has been stamped (either to form just the openings or both the openings and the retention elements and/or carrier web), it is ready for further processing, either immediately, or at a later time and/or place.

At step 440 of the method 400, a bristle tuft 21, comprising a plurality of the bristle strands 22, is inserted into each of the openings formed in step 420. In some embodiments, at step 450 the proximal end 23 and/or the free end 25 of the bristle tufts may be trimmed or adjusted to a set a desired length and/or contouring (e.g., using the contouring plate as discussed herein).

At step 460 of the method 400, the bristles are bonded. For example, the step 460 may include applying heat to the proximal end of the plurality of bristle tufts 21 to melt the bristles and/or the bristles and the backing material together to form a proximal end head portion 26. Alternatively, laser welding, adhesives, or other bonding techniques may be used for the bonding step.

Optional step 470 resembles optional step 430 and may be performed if step 430 was not performed previously. That is, at step 470, once the merged proximal end head portion of the merged tuft assembly is formed, excess portions of the backing material can be removed to form separate tuft retention elements and/or an interconnected group of tuft retention elements arranged in a tuft carrier web. In step 480 of the method 400, the completed tuft retention elements and/or tuft carrier web can be cut out of the backing material. It is noted that the step 480 may occur directly after, or as part of, the step 430 if desired.

In step 490 of method 400, a platen portion 43 of a brush head neck 40 is positioned in relation to the merged tuft assemblies 20 by placing the tuft carrier assemblies 20 as described above. A matrix 30 can then be injected into the space created between the tuft carrier assemblies and the neck of the brush head. The matrix, when solidified, encompasses or encapsulates at least a portion of the neck and the merged tuft assemblies, to form the completed brush head assembly (e.g., the brush head 10 as shown in FIG. 1A).

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head, the method comprising the steps of:

forming a plurality of retention elements each having one or more openings therethrough;

positioning the retention elements into corresponding recesses of a handling plate;

inserting a bristle tuft into the one or more openings of each corresponding retention element;

bonding a proximal end of each bristle tuft to the corresponding retention element to form a merged proximal end head portion that accrues the bristle tufts and the retention elements together as a plurality of merged tuft assemblies;

positioning a neck of the brush head in relation to the merged tuft assemblies; and encompassing a platen of the neck and the merged tuft assemblies at least partially in a matrix, wherein the forming includes stamping the retention elements from a strip of backing material.

2. The method of claim 1, wherein the retention elements are formed as an interconnected web or a carrier plate.

3. The method of claim 1, wherein the forming includes removing excess material from the retention elements, and wherein the plurality of retention elements are included in a tuft carrier that comprises a carrier plate, one or more webbing links, or a combination including at least one of the foregoing, further comprising stamping the tuft carrier to remove excess material to form the carrier plate or the one or more webbing links.

4. A method for manufacturing a brush head, the method comprising the steps of:

forming a plurality of retention elements each having one or more openings therethrough;

positioning the retention elements into corresponding recesses of a handling plate;

inserting a bristle tuft into the one or more openings of each corresponding retention element;

bonding a proximal end of each bristle tuft to the corresponding retention element to form a merged proximal end head portion that secures the bristle tufts and the retention elements together as a plurality of merged tuft assemblies;

positioning a neck of the brush head in relation to the merged tuft assemblies; and encompassing a platen of the neck and the merged tuft assemblies at least partially in a matrix, wherein the encompassing includes injecting the merged tuft assemblies in a form of tuft spikes into the matrix after solidification of the matrix.

* * * * *